US010559880B1

(12) United States Patent
Garrett et al.

(10) Patent No.: US 10,559,880 B1
(45) Date of Patent: Feb. 11, 2020

(54) MULTI-LAYERED HYBRID BEAMFORMING

(71) Applicant: AVAGO TECHNOLOGIES INTERNATIONAL SALES PTE. LIMITED, Singapore (SG)

(72) Inventors: David Christopher Garrett, Tustin, CA (US); Alireza Tarighat Mehrabani, Irvine, CA (US); Nicholas Ilyadis, Merrimack, NH (US); Eran Ridel, Rosh Ha'aiyn (IL)

(73) Assignee: AVAGO TECHNOLOGIES INTERNATIONAL SALES PTE. LIMITED, Singapore (SG)

( * ) Notice: Subject to any disclaimer, the term of this patent is extended or adjusted under 35 U.S.C. 154(b) by 411 days.

(21) Appl. No.: 15/336,738

(22) Filed: Oct. 27, 2016

Related U.S. Application Data

(60) Provisional application No. 62/327,368, filed on Apr. 25, 2016.

(51) Int. Cl.
*H01Q 3/28* (2006.01)
*H01Q 1/24* (2006.01)
*H01Q 3/38* (2006.01)

(52) U.S. Cl.
CPC ..... *H01Q 3/38* (2013.01); *H01Q 1/241* (2013.01)

(58) Field of Classification Search
CPC ..... H01Q 3/38; H01Q 1/241
USPC ..... 342/372
See application file for complete search history.

(56) References Cited

U.S. PATENT DOCUMENTS 4,170,766 A * 10/1979 Pridham ..... G01S 3/805 342/374
6,377,558 B1 * 4/2002 Dent ..... H01Q 3/40 342/354
6,411,979 B1 * 6/2002 Greenberger ..... G06F 7/4812 708/622
8,441,969 B2 * 5/2013 Ji ..... H01Q 3/26 370/310
9,363,683 B2 * 6/2016 Raghavan ..... H04W 16/28
2002/0070896 A1 * 6/2002 Phelan ..... H01P 1/181 342/372
2012/0326925 A1 * 12/2012 Chang ..... G01S 19/21 342/357.59
2014/0010178 A1 * 1/2014 Yu ..... H04W 74/0833 370/329

OTHER PUBLICATIONS

Sohrabi et al., "Hybrid Digital and Analog Beamforming Design for Large-Scale Antenna Arrays", IEEE Journal of Selected Topics in Signal Processing, vol. 10, No. 3, Apr. 2016 (Year: 2016).*

* cited by examiner

*Primary Examiner* — Frank J McGue
(74) *Attorney, Agent, or Firm* — Morgan, Lewis & Bockius LLP

(57) ABSTRACT

A device that implements hybrid beamforming may include at least one processor configured to determine a first beam setting based on a first set of criteria associated with a first user device. The at least one processor may be configured to form a first beam based on the first beam setting using at least one digital beamforming circuit and at least one radio frequency (RF) beamforming circuit. The at least one processor may be configured to transmit, via first antenna elements, the first beam to the first user device.

20 Claims, 12 Drawing Sheets

MULTI-LAYERED HYBRID BEAMFORMING

CROSS-REFERENCE TO RELATED APPLICATIONS

The present application claims the benefit of U.S. Provisional Patent Application Ser. No. 62/327,368, entitled "Hybrid Beamforming," filed on Apr. 25, 2016, which is hereby incorporated by reference in its entirety for all purposes.

TECHNICAL FIELD

The present description relates generally to beamforming, including multi-layered hybrid analog-digital beamforming.

BACKGROUND

Millimeter wavelength (mmWave) applications in consumer electronics typically benefit from lower power and cost in exchange for lower performance (e.g., shorter range). On the other end of the spectrum, backhaul mmWave applications may have high performance requirements in terms of range and coverage but can tolerate higher power consumption and cost. For example, backhaul mmWave applications may require a large number of antenna elements, such as fifty or more antenna elements.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
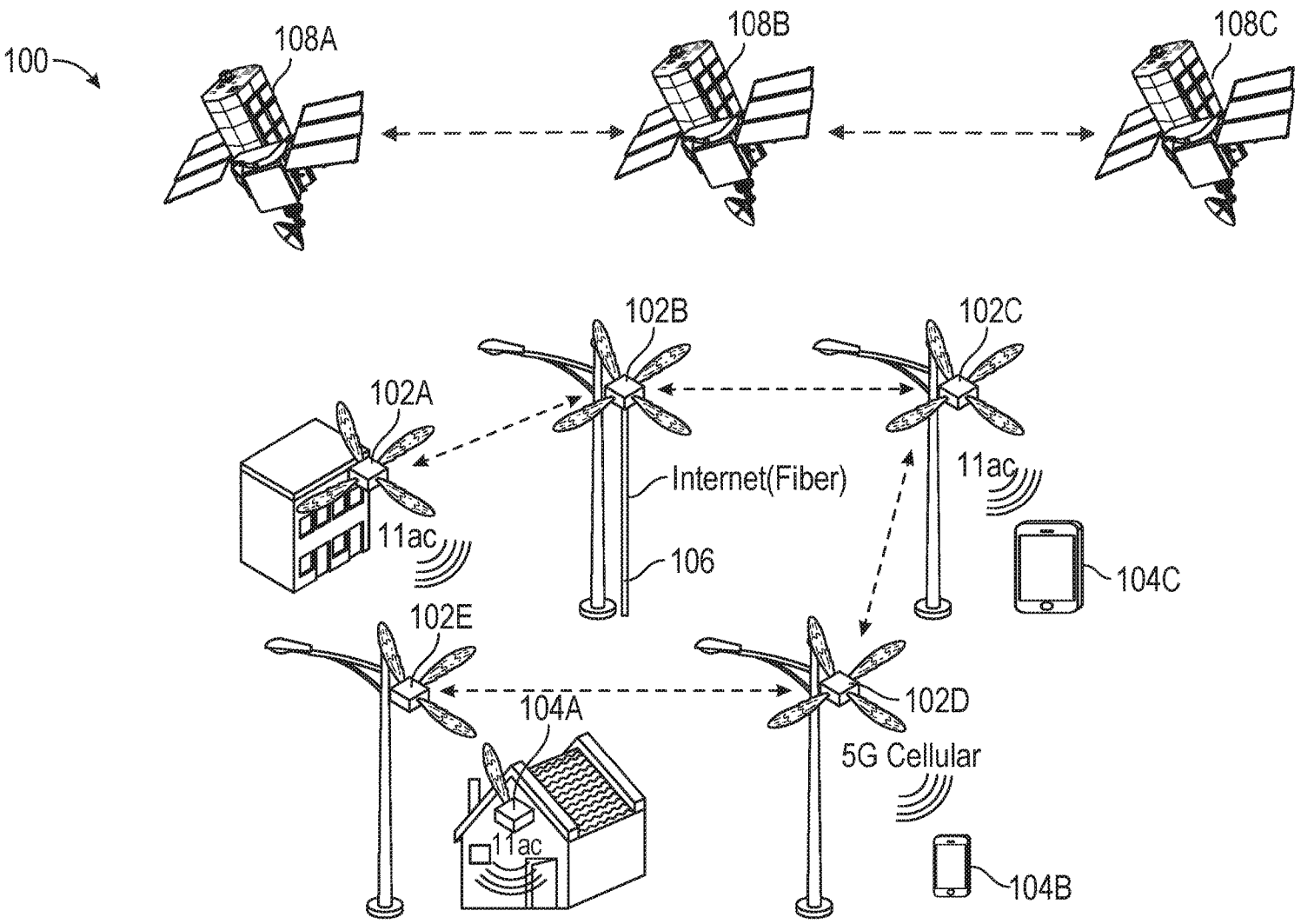
FIG. 1 illustrates an example network environment in which hybrid beamforming may be implemented in accordance with one or more implementations.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced using one or more implementations. In one or more instances, structures and components are shown in block diagram form in order to avoid obscuring the concepts of the subject technology.

Beamforming may be used by a base station to steer receive and/or transmit beams in the direction of a user device, and/or vice versa. For example, beamforming may allow focusing/steering of transmitted and/or received beams in a desired direction to overcome unfavorable path loss (e.g., avoid path(s) associated with higher loss). Beamforming may also be referred as beam steering or simply steering. For transmitting signals, transmit beamforming may be utilized to increase signal directivity. The increased signal directivity may allow, for example, an increase in propagation distance of a beamformed signal (e.g., relative to a signal transmitted without beamforming) and/or a reduction in signal interference with users other than an intended recipient of the beamformed signal. For receiving signals, receive beamforming may increase reception sensitivity of signals from a specific direction and reduce interfering signals by focusing signal reception in the specific direction and/or blocking signals from other directions. Different beam settings may involve, by way of non-limiting example, beams in different directions (e.g., different rotations), beams at different power levels (e.g., different amplitudes), beams using different groups of antenna elements, etc.

Beamforming may be performed in the analog domain, such as on radio frequency (RF) signals, or in the digital domain. In some cases, analog beamforming may be associated with lower power, lower chip area, and/or lower cost than digital beamforming, while digital beamforming may allow better control over gain and phase, which may facilitate improved sidelobe suppression. For example, analog beamforming (e.g., components/operations associated with analog beamforming) may be more sensitive to temperature variation than digital beamforming.

In the subject system, beamforming can be used by a base station (and/or other devices) in both the analog and digital domains, for example, to generate combined beams (with higher transmit and receive gain), and/or to generate distinct beam patterns covering multiple directions at the same time. In some cases, the beam patterns may be at the same frequency. The multiple beam patterns may be associated with communication between the base station and another base station and/or one or more user devices. Accordingly, a device implementing the subject system for hybrid analog-digital beamforming can benefit from the lower power and lower chip area provided by analog beamforming while still realizing the finer control over gain and phase provided by digital beamforming.

FIG. 1 illustrates an example network environment 100 in which hybrid beamforming may be implemented in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The example network environment 100 includes one or more base stations 102A-E and one or more user devices 104A-C. One or more of the base stations 102A-E, such as the base station 102B, may be coupled to a network, such as the Internet, via a transmission media 106, such as a fiber optic transmission media. In one or more implementations, the transmission media 106 may be shared by tens, hundreds, thousands, or any number of base stations 102A-E and/or nodes.

The base stations 102A-E utilize one or more wireless communication technologies, such as mmWave technologies, to communicate with one another, e.g. via backhaul communications. For example, the base stations 102A,C-E may utilize backhaul communications to access/share the network connection of the base station 102B, e.g. via the transmission media 106. The base stations 102A-E may be arranged in a star topology, a ring topology, a mesh topology, or generally any network topology through which backhaul communications may be implemented. One or more of the base stations 102A-E and/or the user devices 104A-C may include all or part of the system discussed below with respect to FIG. 10.

The base stations 102A-E also communicate with one or more of the user devices 104A-C using one or more wireless communication technologies, such as Wi-Fi (802.11ac, 802.11ad, etc.), cellular (3G, 4G, 5G, etc.). For example, the base stations 102A,C may communicate with one or more of the user devices 104A-C using 802.11ac communications, while the base station 102D may communicate with one or more of the user devices 104A-C using 5G cellular communications. In one or more implementations, the base stations 102A-E may have a small form factor, such as five inches by five inches by five inches (height by width by depth), and may be mounted, for example, on telephone poles and/or other municipal infrastructure. Thus, the base stations 102A-E may be used to provide low-cost municipal Wi-Fi, e.g. nodes utilizing 802.11ac technology and/or communicating over unlicensed bands, for providing 4G/5G small cell backhauling, and/or for providing broadband and fiber to homes and/or dwelling units, e.g. to cover the last mile through multiple hops to provide, e.g. gigabit speeds to homes and/or dwelling units.

In one or more implementations, the base stations 102A-E may be attached to, and/or included in, an airborne object, such as a hot air balloon, a drone airplane, a satellite, and the like. For example, there may be one or more satellites 108A-C, such as hundreds of satellites, in orbit over the earth that each has a base station attached, and/or included. One or more base stations of one or more of the satellites 108A-C may communicate utilizing backhaul communications, e.g. via mmWave, and one or more base stations of one or more satellite 108A-C may also communicate with one or more user devices, such as satellite receiver devices, on earth, such as via spot beams. In one or more implementations, one or more of the base stations of one or more of the satellites 108A-C may communicate with one or more of the base stations 102A-E on earth, such as using spot beams.

In one or more implementations, the smaller wavelengths associated with mmWave frequencies may facilitate the use of a large number of antenna elements in a small form factor to generate highly directional beams. The large number of antenna elements may facilitate focusing of signals (e.g., for transmitting or receiving) in different directions through different subsets of the antenna elements. In one or more implementations, one or more transmissions and/or one or more receptions may occur simultaneously when the transmission(s) and/or reception(s) do not utilize overlapping antenna element(s).

In order to provide high throughput backhaul communications, e.g. using mmWave communications, the base stations 102A-E may include a large number of antenna elements, such as tens, hundreds, thousands, or any number of antenna elements, to implement directional beamforming. Since the user devices 104A-C may not provide high throughput backhaul communications, the user devices 104A-C may utilize a lesser number of antenna elements than the base stations 102A-E.

In one or more implementations, beam training may be utilized by a transmitter and a receiver to find one or more beams (e.g., one or more beam settings) for use in communications between the transmitter and the receiver. The base stations 102A-E and/or the user devices 104A-C may each be operable as the transmitter or the receiver. In some cases, the base stations 102A-E and/or the user devices 104A-C may concurrently transmit signals while receiving signals (e.g., operate concurrently as a transmitter and a receiver). The beam settings may include settings for the phase shifters, settings for the amplifiers, and/or settings for which antenna elements to use for receiving or transmitting, etc., to produce the beams that allow high quality communication between the transmitter (e.g., the base station 102A) and the receiver (e.g., the user device 104A). High quality communication may be associated with, for example, higher signal-to-noise ratio (SNR).

The beam training may include performing, by the transmitter and/or the receiver, one or more channel estimation operation(s) to estimate a communication channel (e.g., a wireless communication channel) between the transmitter and the receiver. In some cases, the beam training may take into consideration the base stations and/or the user devices that may be concurrently supported by the transmitter and the receiver. For example, the beam setting utilized by the transmitter to form and transmit a beam to the receiver may be different when the transmitter transmits a beam only to the receiver compared to when the transmitter simultaneously transmits a beam to the receiver and one or more beams to one or more other receivers.

The beam training may be utilized to find multiple candidate beams, such that when a beam utilized for communication and originally associated with a highest quality decreases in quality, the transmitter may transition to another beam and utilize the other beam for communication. The quality of communication associated with a beam may change when the receiver has moved and/or the channel has changed (e.g., an obstruction has been introduced in the channel between the transmitter and the receiver). In some cases, the receiver may be listening for beams in an omnidirectional manner, such that beams of different beam settings (e.g., from the transmitter) may be sensed. After receiving the beams, the receiver may provide feedback to the transmitter indicating which of the beam settings are associated with higher quality beams. The beam settings of the candidate beams may be stored by the transmitter and/or the receiver.

Beamforming (e.g., transmit and receive beamforming) may also be applied in a multi-layered hybrid beamforming manner. The multi-layered hybrid beamforming may include more than two layers of beamforming. For an RF signal, analog beamforming (e.g., RF beamforming) may be applied to the RF signal, the beamformed RF signal may be converted to a digital signal, the digital signal may be processed (e.g., filtered) using a digital signal processor (DSP), the processed digital signal may be converted back to an analog signal, and additional analog beamforming may be applied to the analog signal. The DSP may include Fast Fourier Transform (FFT) circuits, Inverse FFT (IFFT) circuits, and/or summation circuits. In some cases, additional digital beamforming and/or additional analog beamforming operations may be utilized. Thus, the multi-layered hybrid beamforming is performed in the analog domain, then the digital domain, and then again in the analog domain.

Figure 2:
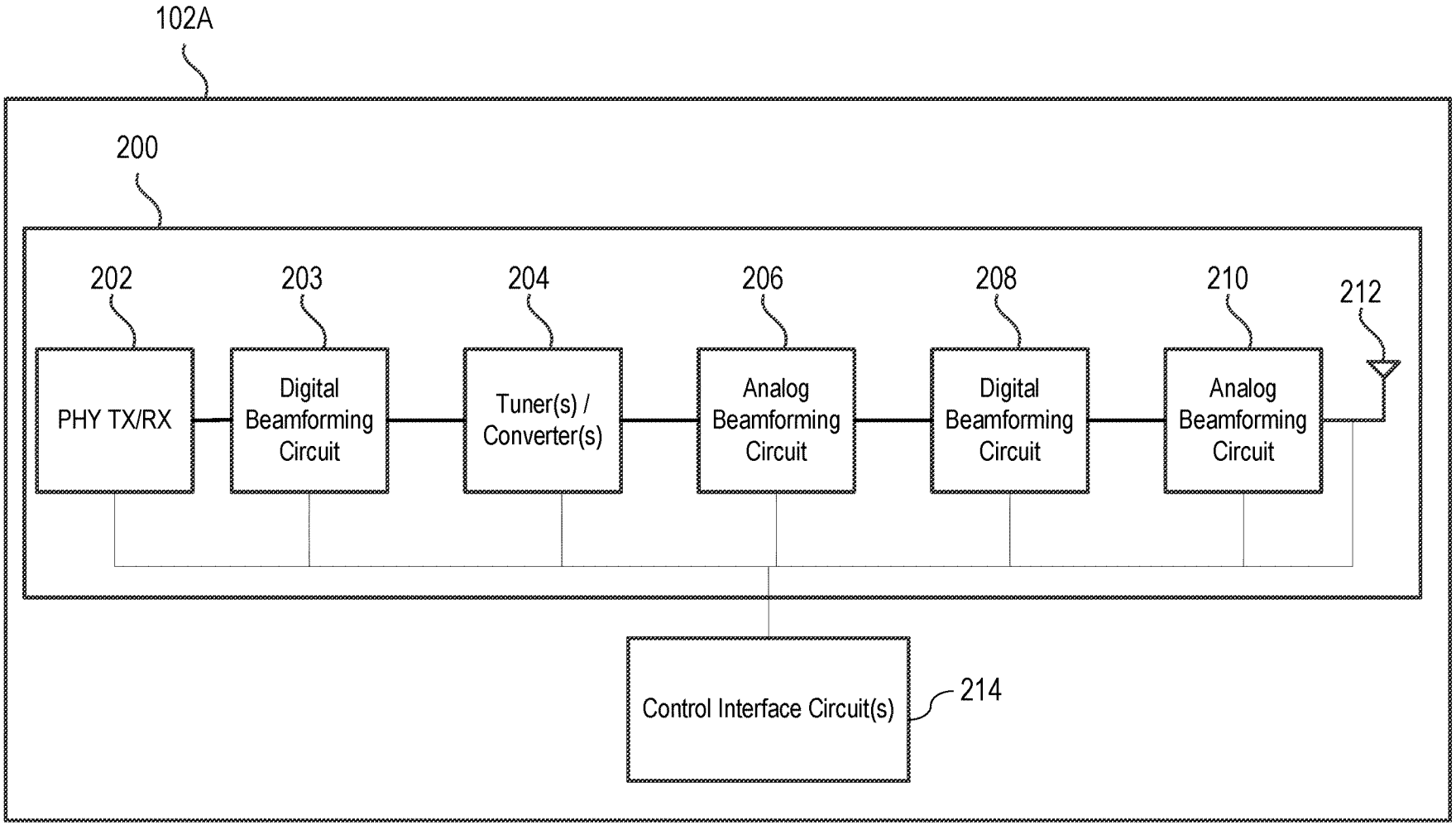
FIG. 2 illustrates an example base station device that includes a hybrid beamforming circuit in accordance with one or more implementations.

FIG. 2 illustrates an example base station device 102A that includes an example hybrid beamforming circuit 200 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided. In one or more implementations, any one of the other base stations 102B-E and/or any of the user devices 104A-C may include all or part of the hybrid beamforming circuit 200.

The hybrid beamforming circuit 200 includes a physical layer (PHY) transceiver (TX/RX) 202, a digital beamforming circuit 203, a tuner circuit(s) and a converter circuit(s) 204 (hereafter a tuner/converter circuit(s) 204), an analog beamforming circuit 206, a digital beamforming circuit 208, an analog beamforming circuit 210, and an antenna element(s) 212. The hybrid beamforming circuit 200 may include a transmit path utilized for transmitting signals to the antenna element(s) 212 and a receive path utilized for receiving signals from the antenna element(s) 212.

When transmitting signals to the antenna element(s) 212, a PHY transmitter of the PHY TX/RX 202 may generate one or more signals. Each generated signal may be associated with a respective path (e.g., RF path/chain). In some cases, the paths may be utilized for a multiple-input multiple-output (MIMO) case. Each path may be associated with a different stream, with each stream being associated with the same frequency and/or one or more different frequencies. Each of the generated signals may be provided to the digital beamforming circuit 203 and/or the tuner/converter circuit(s) 204, and/or one or more of the generated signals may be provided to one or more different digital beamforming circuits (not shown), and/or one or more different tuner/converter circuits (not shown), such as in a branching and/or hierarchical fashion.

The digital beamforming circuit 203 may process the one or more signals received from the PHY transmitter of the PHY TX/RX 202. The digital beamforming circuit 203 may include an analog-to-digital converter (ADC) circuit(s) to convert received analog signals to digital signals, a digital signal processor (DSP) circuit(s) to process the digital signals as appropriate to implement directional beamforming, and a DAC circuit(s) to convert the processed digital signals to analog signals. In one or more implementations, the PHY TX/RX 202 may provide digital signals to the digital beamforming circuit 203, in which case the digital beamforming circuit 203 may not perform the analog to digital conversion and/or may not include the ADC circuit(s). In some cases, the DSP circuit(s) of the digital beamforming circuit 203 may include an FFT circuit(s) to convert digital signals in the time domain to the frequency domain, an IFFT circuit(s) to convert digital signals in the frequency domain to the time domain, and a gain/phase block(s) (e.g., interspersed between the FFT and IFFT circuit(s)) to apply gain and/or phase shift(s) to the digital signals. The digital beamforming circuit 203 may output the processed signals to the tuner/converter circuit(s) 204, and/or the digital beamforming circuit 203 may output one or more of the processed signals to one or more other tuner/converter circuits (not shown), such as in a branching and/or hierarchical fashion. An example of the digital beamforming circuit 203 is discussed further below with respect to FIGS. 5A and 5B.

The tuner/converter circuit(s) 204 may bring the respective signal in each path to an intermediate frequency (IF) or a radio frequency (RF). For example, the tuner/converter circuit(s) 204 may include a digital-to-analog converter (DAC) circuit(s) that converts the signals from the digital beamforming circuit 203 to analog signals and a tuner circuit(s) that brings the analog signals to a desired frequency. In one or more implementations, the digital beamforming circuit 203 may provide one or more analog signals to the tuner/converter circuit(s) 204 in which case the tuner/converter circuit(s) 204 may not perform the digital to analog conversion and/or may not include the DAC circuit(s). The tuner/converter circuit(s) 204 may output the processed signals to the analog beamforming circuit 206 and/or the tuner/converter circuit(s) 204 may output one or more of the processed signals to one or more other analog beamforming circuits (not shown), such as in a branching and/or hierarchical fashion.

In one or more implementations, the hybrid beamforming circuit 200 may not include and/or may bypass the digital beamforming circuit 203, in which case the tuner/converter circuit(s) 204 may receive one or more digital and/or analog signals directly from the PHY TX/RX 202. In the case of received digital signals, the DAC circuit(s) of the tuner/converter circuit(s) 204 convert the digital signals to analog signals and a tuner circuit(s) of the tuner/converter circuit(s) 204 brings the analog signals to the desired frequency.

The analog beamforming circuit 206 may process the analog signals received from the tuner/converter circuit(s) 204 by applying gain and/or phase shift (e.g., via gain/phase block(s)) to the analog signal(s). In one or more implementations, the gain/phase block(s) may include amplifier circuit(s) and/or phase shifter circuit(s) to apply the gain and/or phase shift(s). The gain applied to a signal may be an amplification of the signal or an attenuation of the signal (e.g., negative gain). The gain and/or phase shift applied to one analog signal can be the same or can be different from the gain and/or phase shift applied to another analog signal, for example, as appropriate to implement directional beamforming. In some cases, each analog signal may be split into multiple signals, with a gain and/or phase shift applied to each of these multiple signals. The analog beamforming circuit 206 may output the processed signals to the digital beamforming circuit 208 and/or one or more of the processed signals may be output to one or more other digital beamforming circuits (not shown), e.g. in a branching and/or hierarchical fashion.

The digital beamforming circuit 208 may process the analog signals received from the analog beamforming circuit 206. The digital beamforming circuit 208 may include an analog-to-digital converter (ADC) circuit(s) to convert received analog signals to digital signals, a digital signal processor (DSP) circuit(s) to process the digital signals as appropriate to implement directional beamforming, and a DAC circuit(s) to convert the processed digital signals to analog signals. In some cases, the DSP circuit(s) of the digital beamforming circuit 208 may include an FFT circuit(s) to convert digital signals in the time domain to the frequency domain, an IFFT circuit(s) to convert digital signals in the frequency domain to the time domain, and a gain/phase block(s) (e.g., interspersed between the FFT and IFFT circuit(s)) to apply gain and/or phase shift(s) to the digital signals. The digital beamforming circuit 208 may output the processed signals to the analog beamforming circuit 210 and/or one or more of the processed signals may be output to one or more other analog beamforming circuits (not shown), such as in a branching and/or hierarchical fashion. An example of the digital beamforming circuit 208 is discussed further below with respect to FIGS. 5A and 5B.

The analog beamforming circuit 210 may process the analog signals received from the digital beamforming circuit 208 by applying gain and/or phase shift (e.g., via gain/phase block(s)) to the analog signals, as appropriate to implement directional beamforming. The analog beamforming circuit 210 may provide the processed analog signals to one or more the antenna element(s) 212. In some cases, the analog beamforming circuit 210 may be coupled to the antenna element(s) 212 via power amplifier(s) (not shown). The processed analog signals may be provided to the same antenna element(s) 212 and/or one or more of the analog signals may be provided to different antenna element(s). For example, the antenna element(s) 212 may include a large array of antenna elements, such as 400, 600, or any number of antenna elements, such as in a multi-user MIMO implementation, and the processed analog signals may be provided to different and/or overlapping subsets of the antenna elements. Examples of the analog beamforming circuits 206 and 210 are discussed further below with respect to FIG. 6.

When receiving signals from the antenna element(s) 212, the analog signal(s) received by the antenna element(s) 212 may be coupled to the analog beamforming circuit 210 (e.g., via low noise amplifier(s) (LNA(s)). The analog beamforming circuit 210 may process the analog signals and provide the processed signals to the digital beamforming circuit 208, the digital beamforming circuit 208 may process the analog signals received from the analog beamforming circuit 210 and provide the processed signals to the analog beamforming circuit 206, and the analog beamforming circuit 206 may process the analog signals from the digital beamforming circuit 208. The analog beamforming circuit 210, digital beamforming circuit 208, and analog beamforming circuit 206 may process the signals that they receive by applying gain and/or phase shift to the received signals as appropriate to implement directional beamforming. The digital beamforming circuit 208 may convert the received signals to the frequency domain, process the received signals in the frequency domain, and convert the processed signals to the time domain. The tuner/converter circuit(s) 204 may tune the frequency associated with the analog signals received from the analog beamforming circuit 206 and convert the analog signals to digital signals and provide the digital signals to a PHY receiver of the PHY TX/RX 202.

In one or more implementations, the digital beamforming performed by one or more of the digital beamforming circuits 203,208 may be utilized to facilitate improved sidelobe suppression and/or nulling control (e.g., positioning of the null) relative to a case in which only analog beamforming is utilized. In some cases, the digital beamforming may compensate for phase distortion associated with applying phase shift in the analog domain to signals of frequencies (e.g., band edge frequencies) away from the center frequency. In this regard, the digital beamforming may compensate for the phase distortion associated with the analog beamforming performed by the analog beamforming circuit 206 and/or the analog beamforming circuit 210. For example, the center frequency may be 30 GHz and a band edge may be at 28 GHz. In some cases, the digital beamforming may utilize a phase ramp to reduce (e.g., compensate for) the phase distortion associated with the analog-domain phase shifting and/or the digital beamforming may allow a beam response to be flat over an entire channel bandwidth.

In one or more implementations, one or more of the digital beamforming circuits 203,208 may be utilized to allow frequency selective compensation of phase distortion and/or frequency offset due to analog beamforming performed by the analog beamforming circuit 206 and/or the analog beamforming circuit 210. Analog phase shifters may be considered fixed delay elements at a given frequency. For wideband signals, relative to a center frequency $f_c$, the same delay at a band-edge frequency $f_c+f_{offset}$ is associated with a different effective phase. For instance, $f_c$ may be 60 GHz and $f_c+f_{offset}$ may be between 59 GHz and 61 GHz. Thus, a single phase setting may not be optimal for wideband signals. The phase at the center frequency may be provided by $$\phi(f_c) = \frac{\Delta t}{2\pi f_c}$$

where Δt is a delay shift (e.g., delay setting for a shifter).

The phase at frequencies away from the center frequency by a value $f_{offset}$ may be provided by $$\phi(f_c + f_{offset}) = \frac{\Delta t}{2\pi(f_c + f_{offset})} = \frac{\Delta t}{2\pi f_c}\frac{f_c}{f_c + f_{offset}} = \phi(f_c)\phi_{offset}.$$

The digital beamforming circuit 208 may be utilized to compensate for $\phi_{offset}$. In one or more implementations, such as discussed below with respect to FIG. 5, one or more of the digital beamforming circuits 203,208 may utilize an FFT analysis (e.g., Z-point FFT analysis) to decompose a digital signal into bins (e.g., smaller frequency bands) and compensate for each frequency band separately. Each bin may be associated with weight factors (e.g., determined based on simulation or measurements) to be applied in the FFT analysis. The separately compensated components may then be combined and reconstructed in the time domain. In some implementations, a digital filter may be utilized to compensate for $\phi_{offset}$.

In one or more implementations, the hybrid beamforming circuit 200 may include, or may otherwise be coupled to, a control interface circuit 214 that generates control signals to the various components shown in FIG. 2. In some aspects, the control signals may be indicative of beam settings (e.g., beam power, beam direction) to be effectuated by the hybrid beamforming circuit 200. For example, the control signals may be utilized to turn on/off one or more components (e.g., gain/phase blocks, antenna elements); set the gain of the frequency bin gain/phase blocks; set the granularity of the ADCs and/or DACs, program interconnections within and between the various components in FIG. 2; and so forth.

In some cases, for each beam setting, the control signals may be utilized to set the gain and/or phase shift applied by each individual gain/phase block of the digital beamforming circuit 203, the analog beamforming circuit 206, digital beamforming circuit 208, and/or analog beamforming circuit 210, and/or select which antenna elements to utilize (e.g., switch on, switch off) for transmitting/receiving for each signal. In other cases, for each beam setting, the control signals may indicate a beam power and/or beam direction to be effectuated by the hybrid beamforming circuit 200, and the hybrid beamforming circuit 200 has autonomy to determine how to configure individual gain/phase blocks and/or antenna elements (e.g., switch on or off antenna elements) to effectuate the beam setting.

In one or more implementations, the various components of the hybrid beamforming circuit 200 may be coupled using, for instance, coaxial cables and/or microstrip lines. For example, the analog beamforming circuit 206 may be coupled to the digital beamforming circuit 208 using coaxial cables and/or microstrip lines, and/or the digital beamforming circuit 208 may be coupled to the analog beamforming circuit 210 using coaxial cables and/or microstrip lines. In one or more implementations, the converting of analog signals to digital signals and digital signals to analog signal sin the hybrid beamforming circuit 200 may provide flexibility in terms of data transfer from one component of the hybrid beamforming circuit 200 to another component of the hybrid beamforming circuit 200. The components of the hybrid beamforming circuit 200 may be split across multiple chips and through high-speed digital buses.

In one or more implementations, one or more of the PHY TX/RX 202, the digital beamforming circuit 203, the tuner/converter circuit(s) 204, the analog beamforming circuit 206, the digital beamforming circuit 208, the analog beamforming circuit 210, control interface circuit 214, and/or one or more portions thereof, may be implemented in software (e.g., subroutines and code), may be implemented in hardware (e.g., an Application Specific Integrated Circuit (ASIC), a Field Programmable Gate Array (FPGA), a Programmable Logic Device (PLD), a controller, a state machine, gated logic, discrete hardware components, or any other suitable devices) and/or a combination of both.

Figure 3:
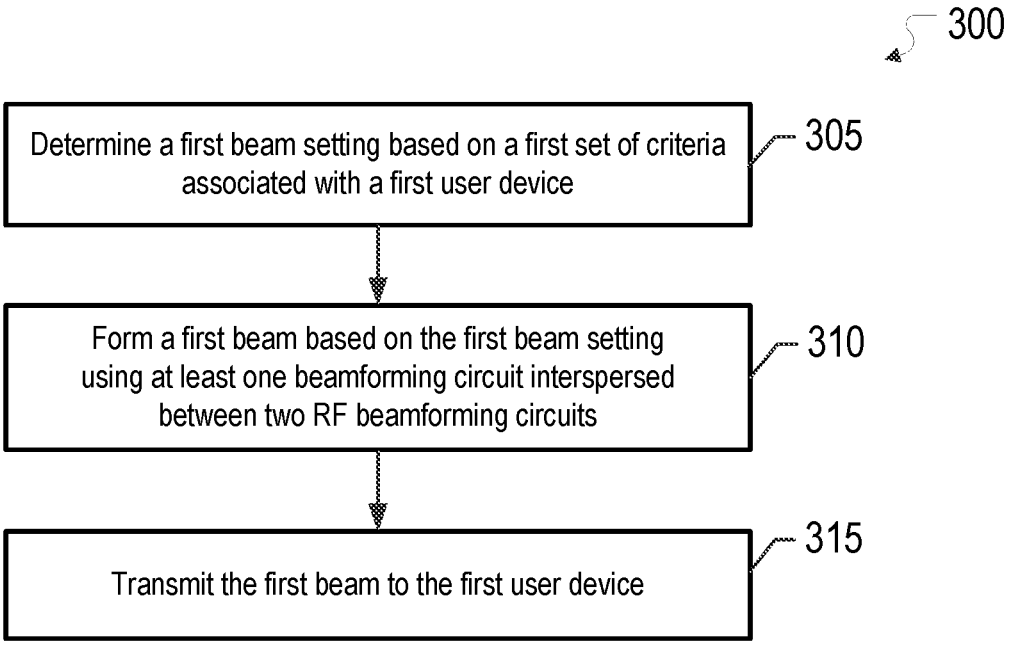
FIG. 3 illustrates a flow diagram of an example process for facilitating hybrid beamforming in accordance with one or more implementations.

FIG. 3 illustrates a flow diagram of an example process 300 for facilitating hybrid beamforming in accordance with one or more implementations. For explanatory purposes, the example process 300 is primarily described herein with reference to the base station 102A and the user device 104A in the network environment 100 of FIG. 1 and the hybrid beamforming circuit 200 of FIG. 2. Further, for explanatory purposes, the base station 102A and/or the user device 104A include the hybrid beamforming circuit 200. However, the example process 300 is not limited to the base station 102A, the user device 104A, and/or the hybrid beamforming circuit 200, and one or more blocks (or operations) of the example process 300 may be performed by one or more components of the base station 102A, the user device 104A, and the hybrid beamforming circuit 200. Further for explanatory purposes, the blocks of the example process 300 are described herein as occurring in serial, or linearly. However, multiple blocks of the example process 300 may occur in parallel. In addition, the blocks of the example process 300 need not be performed in the order shown and/or one or more of the blocks of the example process 300 need not be performed.

In the process 300, the base station 102A determines a first beam setting based on a first set of criteria associated with the user device 104A (305). By way of non-limiting example, the criteria may include link requirements between the base station 102A and the user device 104A, distance between the base station 102A and the user device 104A, required signal strength, and/or a combination thereof, among other criterion.

The base station 102A forms a first beam based on the first beam setting using at least one digital beamforming circuit (e.g., the digital beamforming circuit 208) interspersed between two radio frequency (RF) beamforming circuit (e.g., the analog beamforming circuits 206 and 210) (310). The base station 102A may form the first beam by generating, using the PHY TX/RX 202, signals to be processed by the tuner/converter circuit(s) 204, the analog beamforming circuit 206, the digital beamforming circuit 208, and the analog beamforming circuit 210. The analog beamforming circuit 206, the digital beamforming circuit 208, and the analog beamforming circuit 210 may apply gain and/or phase shifts to effectuate the first beam setting (e.g., beam direction, beam power). The first beam may be an output of the analog beamforming circuit 210.

The base station 102A transmits the first beam to the user device 104A (315). The base station 102A may transmit the first beam via the antenna element(s) 212. The particular antenna element(s) 212 selected and/or utilized to transmit the first beam may be indicated by the first beam setting. In some cases, a subset (e.g., less than all) of the antenna element(s) 212 is utilized to transmit the first beam. For example, to effectuate the first beam setting (e.g., beam direction, beam power), a certain set of contiguous and/or non-contiguous antenna element(s) 212 may be switched on and a certain set of other contiguous and/or non-contiguous antenna element(s) 212 may be switched off (e.g., not take part in the transmission of the first beam). In some aspects, a control interface circuit 214 may be utilized to generate and transmit a control signal(s) to the analog beamforming circuit 206, the digital beamforming circuit 208, the analog beamforming circuit 210, and/or the antenna element(s) 212 to effectuate the first beam setting. In some cases, the certain set of other contiguous and/or non-contiguous antenna element(s) 212 that do not take part in the transmission of the first beam may be utilized for transmission of other beams (e.g., to the user device 104A and/or to base stations and/or other devices). In one or more implementations, the one or more antenna elements 212 for transmitting the first beam may be selected using, for example, the dithering circuit that is discussed further below with respect to FIG. 9.

Figure 4:
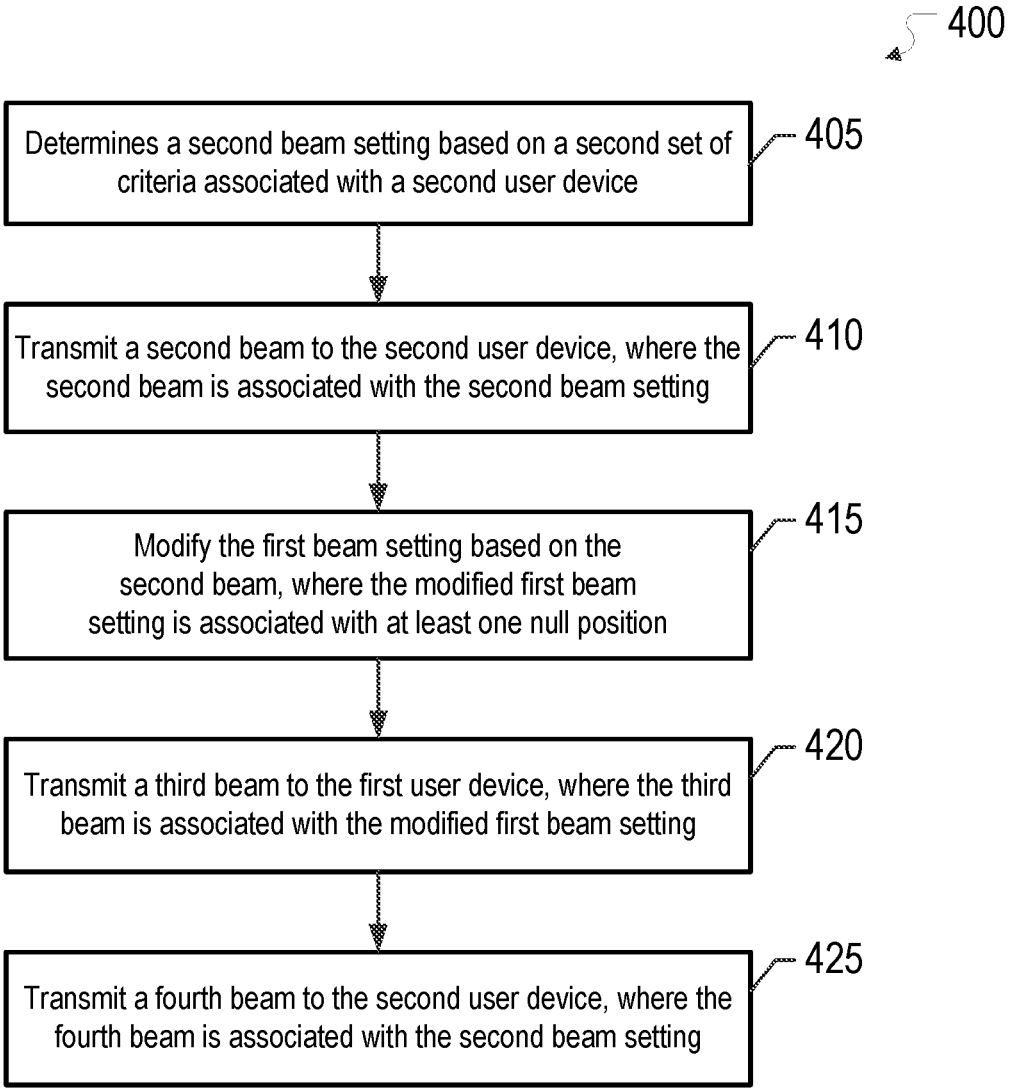
FIG. 4 illustrates a flow diagram of an example process for facilitating hybrid beamforming in accordance with one or more implementations.

FIG. 4 illustrates a flow diagram of an example process 400 for facilitating hybrid beamforming in accordance with one or more implementations. For explanatory purposes, the example process 400 is primarily described herein with reference to the base station 102A and the user devices 104A-B in the network environment 100 of FIG. 1 and the hybrid beamforming circuit 200 of FIG. 2. Further, for explanatory purposes, the base station 102A and the user devices 104A-B include the hybrid beamforming circuit 200. However, the example process 400 is not limited to the base station 102A, the user devices 104A-B, and the hybrid beamforming circuit 200, and one or more blocks (or operations) of the example process 400 may be performed by one or more components of the base station 102A, the user devices 104A-B, and the hybrid beamforming circuit 200. Further for explanatory purposes, the blocks of the example process 400 are described herein as occurring in serial, or linearly. However, multiple blocks of the example process 400 may occur in parallel. In addition, the blocks of the example process 400 need not be performed in the order shown and/or one or more of the blocks of the example process 400 need not be performed.

The process 400 may, some implementations, be performed after the example process 300. In the process 400, the base station 102A determines a second beam setting based on a second set of criteria associated with the user device 104B (405). By way of non-limiting example, the criteria may include link requirements between the base station 102A and the user device 104B, distance between the base station 102A and the user device 104B, required signal strength, and/or a combination thereof, among other criterion.

The base station 102A transmits a second beam to the user device 104B (410). The base station 102A may form the second beam based on the second beam setting (e.g., using the digital beamforming circuit 208 interspersed between the analog beamforming circuits 206 and 210). The base station 102A transmits the first beam via the antenna element(s) 212. In some cases, when the first and second beams may be transmitted using different antenna elements, the first and second beams may be simultaneously transmitted to the user device 104A and the user device 104B. In other cases, the antenna elements utilized to transmit the first beam may overlap those utilized to transmit the second beam. In one or more implementations, the one or more antenna elements 212 for transmitting the second beam may be selected using, for example, the dithering circuit that is discussed further below with respect to FIG. 9.

The base station 102A modifies the first beam setting based on the transmission or expected transmission of the second beam (415). The modified first beam setting may be associated with at least one null position. The null position(s) may be in the direction of the user device 104B. For example, the null position(s) associated with the modified first beam setting may be associated with transmission peaks of the second beam. The first beam setting may be utilized to allow the base station 102A to reduce cross interference between the first beam and the second beam and, thus, concurrently (e.g., simultaneously, serially, etc.) service the user devices 104A-B with higher quality communication. The modified first beam setting may be effectuated by adjusting the gain and/or phase shifts applied by the analog beamforming circuit 206, the digital beamforming circuit 208, and/or the analog beamforming circuit 210, and/or adjusting the antenna element(s) 212 selected to transmit the beam. In some cases, alternatively or in addition, the second beam setting may be modified to facilitate communication between the base station 102A and the user devices 104A-B.

The base station 102A may transmit a third beam to the user device 104A (420), where the third beam is associated with the modified first beam setting. The base station 102A may adjust the first beam settings in such a manner that the first beam transitions to the third beam without disruption to the user device 104A. In some cases, the modification of the first beam setting may cause the base station 102A to utilize a different set of antenna elements (e.g., among the antenna element(s) 212) from the set of antenna elements utilized prior to the modification of the first beam setting. The base station 102A may transmit a fourth beam to the user device 104B (425), where the fourth beam is associated with the second beam setting. The base station 102A may modify the second beam settings in such a manner that the second beam transitions to the fourth beam without disruption to the user device 104B.

In one or more implementations, the base station 102A determines the modified first beam setting in conjunction with determining the second beam setting and/or in conjunction with determining the modified second beam setting. For example, if the base station 102A determines that the second beam will possibly overlap and/or interfere with the first beam, the base station 102A may determine the modified first beam settings in conjunction with determining the second beam settings. Alternatively, and/or in addition, if the base station 102A determines that the established second beam may begin to interfere with the first beam, e.g., due to movement of the base station 102 and/or the receiving device, the base station 102A may determine the modified first beam settings in conjunction with determining the modified second beam settings. In one or more implementations, the modified first beam settings and the second beam settings and/or the modified first beam settings and the modified second beam settings may be determined using one or more multivariate equations that incorporate variables corresponding to each of the beams.

Figure 5A:
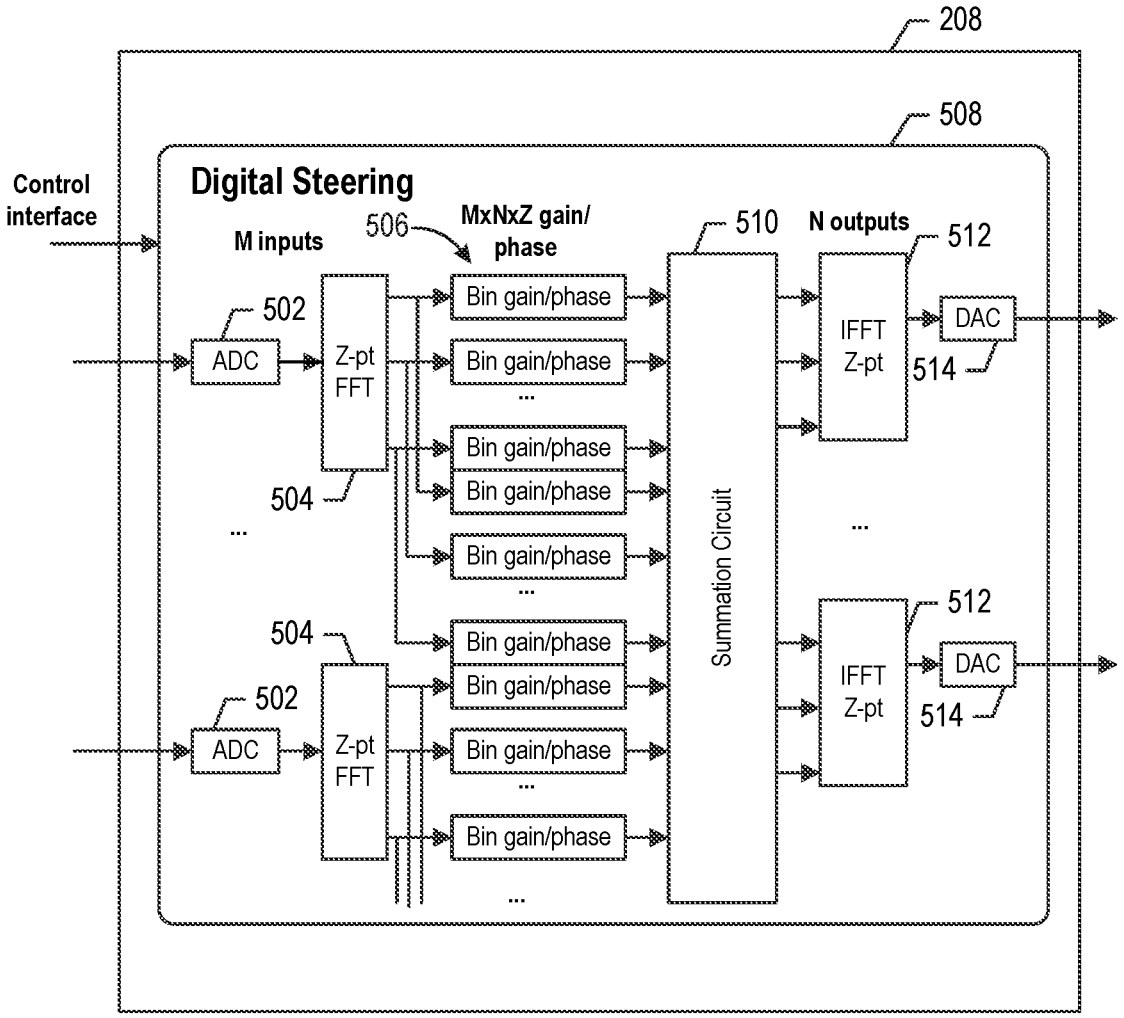
FIG. 5A illustrates an example transmit path of a digital beamforming circuit in accordance with one or more implementations.

FIG. 5A illustrates an example of a transmit path of the digital beamforming circuit 208 of FIG. 2 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The digital beamforming circuit 208 may include a digital steering circuit 508. The digital steering circuit 508 may be utilized to process signals to be transmitted by the hybrid beamforming circuit 200 via the antenna element(s) 212. The digital steering circuit 508 receives analog signals (e.g., from the analog beamforming circuit 206), digitizes the analog signals, processes the digital signals, converts the processed digital signals to analog signals, and provides the analog signals for transmission (e.g., to the analog beamforming circuit 210). Although the transmit path of the digital beamforming circuit 208 includes a single digital steering circuit in FIG. 5A, the transmit path of the digital beamforming circuit 208 may include more than one digital steering circuit.

The digital steering circuit 508 receives M analog inputs, with each analog input being received by a respective ADC circuit 502. Each ADC circuit 502 generates a respective digital signal based on the respective analog input received by the ADC circuit 502 and transmits the respective digital signal to a respective Z-point FFT circuit 504, where Z is an integer. Each Z-point FFT circuit 504 decomposes the respective digital signal into individual signal components (also referred to as frequency bins), where each individual signal component is associated with a respective portion of a frequency band of the digital signal. Each signal component is processed by a respective frequency bin gain/phase block 506 that applies gain and/or phase to the signal component. The phase distortion associated with each frequency bin may be compensated for separately from phase distortion associated with the other frequency bins.

Outputs of the frequency bin gain/phase blocks 506 may be provided to a summation circuit 510 that generates matrix cross-product terms between the various frequency bins. In this regard, the summation circuit 510 may allow multiple signals to be combined. Outputs of the summation circuit 510 are provided to N Z-point IFFT circuits 512 for reconstruction of time-domain signals. Each of the N outputs from the Z-point IFFT circuits 512 is provided to a respective DAC circuit 514, where each DAC circuit 514 generates an analog signal output. The N analog signals output from the digital steering circuit 508 are provided for transmission by the digital steering circuit 508 (e.g., to the analog beamforming circuit 210).

In some aspects, one or more control interface circuits (e.g., the control interface circuit 214) may provide control signals to the various components shown in FIG. 5A. For instance, the control signals may be utilized to turn on/off one or more components (e.g., Z-point FFT circuits 504, ADC circuits 502, DAC circuits 514, etc.), set the gain of the frequency bin gain/phase blocks 506, set the granularity of the ADC circuits 502 and/or the DAC circuits 514, and so forth.

In one or more implementations, M (of the M inputs) is between 1 and 16 and N (of the N outputs) is between 4 and 16. Z (of the Z-point FFT circuits 504 and the Z-point IFFT circuits 512) may be determined based on a desired granularity in the frequency bins. By way of non-limiting example, Z may be 8 or 1024. In some cases, Z may be 1 (e.g., single bin gain/phase), in which case the Z-point FFT circuits 504 may be considered a pass through circuit that applies gain and/or phase. In some cases, the digital steering circuit 508 may transmit the N analog signals to antenna elements via power amplifiers. In some cases, the digital steering circuit 508 may transmit the N analog signals to analog steering circuits (e.g., of the analog beamforming circuit 210). The digital steering circuit 508 may be split across multiple chips and through high-speed digital buses. In one or more implementations, the digital steering circuit 508 may be preceded by and/or followed by one or more analog steering circuits, as described below with respect to FIGS. 6A, 6B, and 8.

Although the foregoing description describes the digital beamforming circuit 208 with a transmit path for transmitting beamformed signals, the digital beamforming circuit 208 may include a receive path for receiving beamformed signals. The receive path of the digital beamforming circuit 208 may receive and process signals from the analog beamforming circuit 210 and transmit the processed signals to the analog beamforming circuit 206.

Figure 5B:
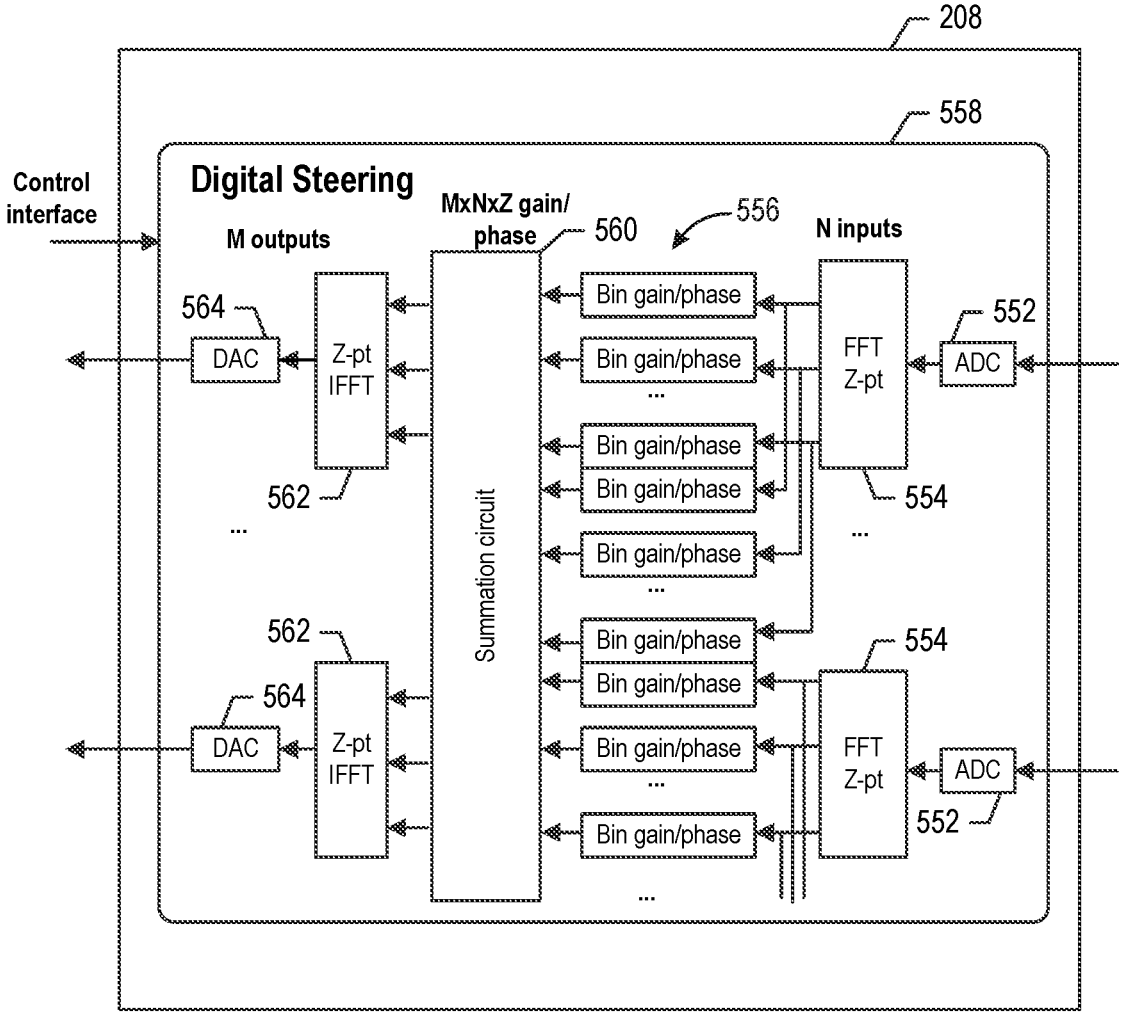
FIG. 5B illustrates an example receive path of a digital beamforming circuit in accordance with one or more implementations.

FIG. 5B illustrates an example of a receive path of the digital beamforming circuit 208 of FIG. 2 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The description for FIG. 5A generally applies to FIG. 5B. In some cases, the digital beamforming circuit 208 may include transmit/receive switches (not shown) that may be utilized to route signals to a transmit path of the digital beamforming circuit 208 or a receive path of the digital beamforming circuit 208. In some cases, the components of the digital beamforming circuit 208 may be configured (e.g., programmed) depending on whether the digital beamforming circuit 208 is being utilized to transmit signals and/or to receive signals. Thus, in some cases, the various components of the transmit path illustrated in FIG. 5A may be re-used in the receive path illustrated in FIG. 5B.

The digital beamforming circuit 208 may include a digital steering circuit 558. The digital steering circuit 558 may be utilized to process signals received by the hybrid beamforming circuit 200 via the antenna element(s) 212. Although the receive path of the digital beamforming circuit 208 includes a single digital steering circuit in FIG. 5B, the receive path of the digital beamforming circuit 208 may include more than one digital steering circuit.

The digital steering circuit 558 receives analog signals (e.g., from the analog beamforming circuit 210), digitizes the analog signals, processes the digital signals, converts the processed digital signals to analog signals, and provide the analog signals for transmission (e.g., to the analog beamforming circuit 206). The digital steering circuit 558 receives N analog inputs, with each analog input being received by a respective ADC circuit 552. Each ADC circuit 552 generates a respective digital signal based on the respective analog input received by the ADC circuit 552 and transmits the respective digital signal to a respective Z-point FFT circuit 554, where Z is an integer. Each Z-point FFT circuit 554 decomposes the respective digital signal into individual signal components, where each individual signal component is associated with a respective portion of a frequency band of the digital signal. Each signal component is processed by a respective frequency bin gain/phase block 556 that applies gain and/or phase to the signal component.

Outputs of the frequency bin gain/phase blocks 556 may be provided to a summation circuit 560 that generates matrix cross-product terms between the various frequency bins. In this regard, the summation circuit 560 may allow multiple signals to be combined. Outputs of the summation circuit 560 are provided to M Z-point IFFT circuits 562 for reconstruction of time-domain signals. Each of the M outputs from the Z-point IFFT circuits 562 are provided to a respective DAC circuit 564, where each DAC circuit 564 generates an analog signal output. The M analog signals output from the digital steering circuit 558 are provided for transmission by the digital steering circuit 558 (e.g., to the analog beamforming circuit 206).

In some aspects, one or more control interface circuit(s) (e.g., the control interface circuit 214) may provide control signals to the various components shown in FIG. 5B. For instance, the control signals may be utilized to turn on/off one or more components (e.g., Z-point FFT circuits 554, ADC circuits 552, DAC circuits 564, etc.), set the gain of the frequency bin gain/phase blocks 556, set the granularity of the ADC circuits 552 and/or DAC circuits 564, and so forth.

In one or more implementations, the hybrid beamforming circuit 200 includes the digital steering circuit 508 and the digital steering circuit 558. The digital steering circuit 508 may be utilized to process signals to be transmitted by the hybrid beamforming circuit 200 (e.g., via the antenna element(s) 212). The digital steering circuit 558 may be utilized to process signals received by the hybrid beamforming circuit 200 (e.g., via the antenna element(s) 212). In some cases, the hybrid beamforming circuit 200 may concurrently transmit and receive signals, such that the digital steering circuit 508 and the digital steering circuit 558 are simultaneously in operation (e.g., simultaneously processing signals). In one or more implementations, the hybrid beamforming circuit 200 may include one or more additional digital steering circuits to process signals to be transmitted and/or an additional one or more additional digital steering circuits to process received signals. The number of digital steering circuits utilized to process signals to be transmitted may be the same, or may be different, from the number of digital steering circuits utilized to process received signals.

In one or more implementations, one or more components of the digital steering circuit 508 and/or the digital steering circuit 558 (e.g., gain/phase blocks 506,556, Z-point FFT circuits 504,554, etc.), may be implemented in software (e.g., subroutines and code), may be implemented in hardware (e.g., an Application Specific Integrated Circuit (ASIC), a Field Programmable Gate Array (FPGA), a Programmable Logic Device (PLD), a controller, a state machine, gated logic, discrete hardware components, or any other suitable devices) and/or a combination of both.

Figure 6A:
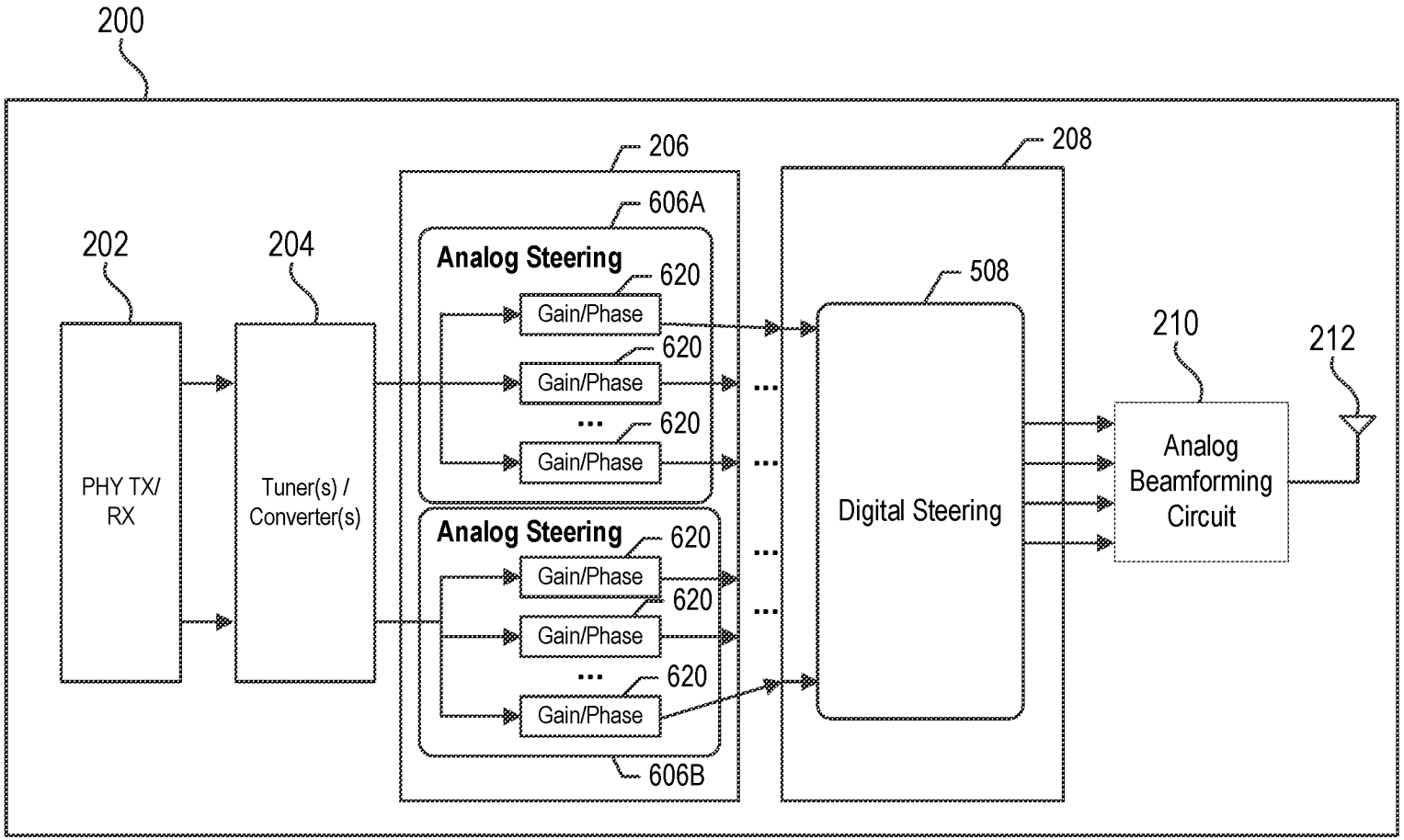
FIG. 6A illustrates an example transmit path of a hybrid beamforming circuit in accordance with one or more implementations.

FIG. 6A illustrates an example of a transmit path of the hybrid beamforming circuit 200 of FIG. 2 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The hybrid beamforming circuit 200 includes the PHY TX/RX 202, the tuner/converter circuit(s) 204, the analog beamforming circuit 206, the digital beamforming circuit 208, the analog beamforming circuit 210, and the antenna element(s) 212. In FIG. 6A, the hybrid beamforming circuit 200 generates one signal for each of two parallel paths, with each path having a different signal. In some cases, the multiple paths may be utilized for a MIMO case. Each path may be associated with a different stream, with each stream being associated with the same frequency. In some cases, the two streams may be destined for the same user device, and may be provided to the same user device using spatial multiplexing. In other cases, each stream is associated with a different user device and different beamforming.

The hybrid beamforming circuit 200 includes the tuner/converter circuit(s) 204. The tuner circuits may bring the signal in each path to an intermediate frequency (IF) or radio frequency (RF). The analog beamforming circuit 206 includes analog steering circuits 606A-B that receive analog output signals of the tuner/converter circuit(s) 204. The analog outputs are split and passed to gain/phase blocks 620 (e.g., transmit phase shifters) that apply phase shift and/or gain to the analog output signals, as appropriate to implement directional beamforming, and transmits the processed signals to the digital beamforming circuit 208. For example, the analog steering circuit 606A includes gain/phase blocks 620. The digital beamforming circuit 208 may include the digital steering circuit 508 shown in FIG. 5. In some cases, the processed signal of each gain/phase block 620 is coupled to a respective ADC circuit 502 of the digital steering circuit 508.

The digital beamforming circuit 208 may process the analog signals from the analog beamforming circuit 206 and provide the processed analog signals (e.g., N output signals) to the analog beamforming circuit 210. The analog beamforming circuit 210 may include one or more analog steering circuits. In some cases, the analog steering circuit(s) of the analog beamforming circuit 210 may include similar components as those shown in the analog steering circuits 606A-B. The analog beamforming circuit 210 may process the analog signals from the digital beamforming circuit 208 and transmit the processed analog signals to the antenna element(s) 212. The analog steering circuits 606A-B may be coupled to the digital steering circuit 508 using, for instance, coaxial cables or microstrip lines. The digital steering circuit 508 may be coupled to the analog beamforming circuit 210 using, for instance, coaxial cables or microstrip lines.

The control interface circuit(s) (e.g., the control interface circuit 214) may provide control signals to the various components of the analog beamforming circuit 206 (e.g., the analog steering circuit 606A and/or 606B), the digital beamforming circuit 208 (e.g., the digital steering circuit 508), the analog beamforming circuit 210, and/or the antenna element(s) 212. For instance, the control signals may be utilized to turn on/off one or more components; set the gain of the frequency bin gain/phase blocks; set the granularity of the ADCs and/or DACs, program interconnections within and between the digital steering circuit 508 and the analog steering circuits 606A-B, within and between the digital steering circuit 508 and the analog beamforming circuit 210, and/or within and between the analog beamforming circuit 210 and the antenna element(s) 212; and so forth. Although FIG. 6A illustrates a transmit path of the hybrid beamforming circuit 200, the hybrid beamforming circuit 200 may also include a receive path. An example of a receive path of the analog steering circuit 606A is described below with respect to FIGS. 6B and 7.

Figure 6B:
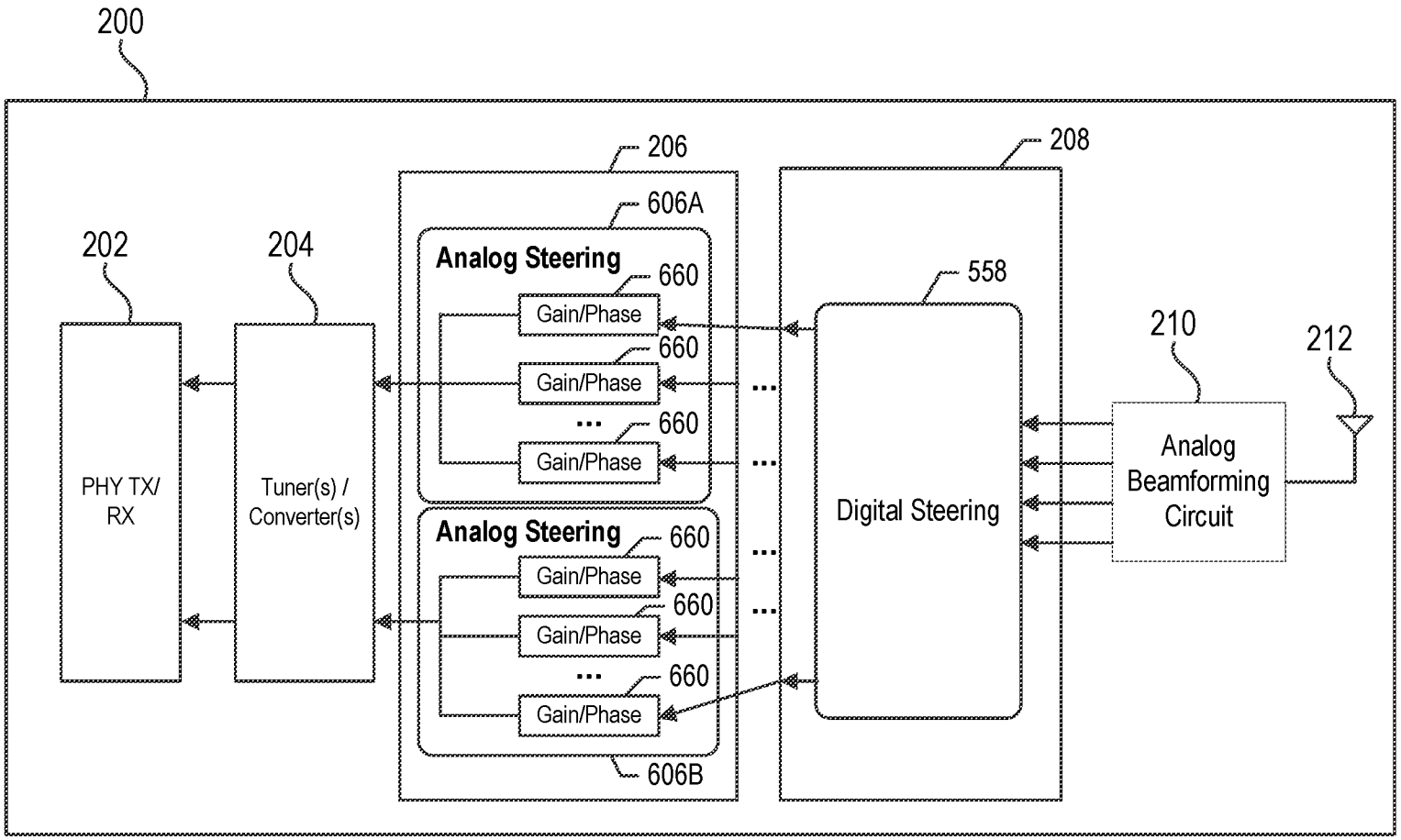
FIG. 6B illustrates an example receive path of a hybrid beamforming circuit in accordance with one or more implementations.

FIG. 6B illustrates an example of a receive path of the hybrid beamforming circuit 200 of FIG. 2 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The description for FIG. 6A generally applies to FIG. 6B. The analog beamforming circuit 210 may include one or more analog steering circuits to receive and process signals from the antenna element(s) 212. The digital beamforming circuit 208 may process signals from the analog beamforming circuit 210, e.g. using the digital steering circuit 558. In one or more implementations, the digital beamforming circuit 208 includes the digital steering circuit 508 (e.g., for the transmit path) and the digital steering circuit 558 (e.g., for the receive path). The analog beamforming circuit 206 may process signals from the digital beamforming circuit 208. For example, the analog steering circuit 606A may include gain/phase blocks 660. The tuner/converter circuit(s) 204 may convert the analog signals from the analog beamforming circuit 206 to the desired frequency and convert the analog signals to digital signals. The digital signals from the tuner/converter circuit(s) 204 may be provided to the PHY receiver of the PHY TX/RX 202.

Figure 7:
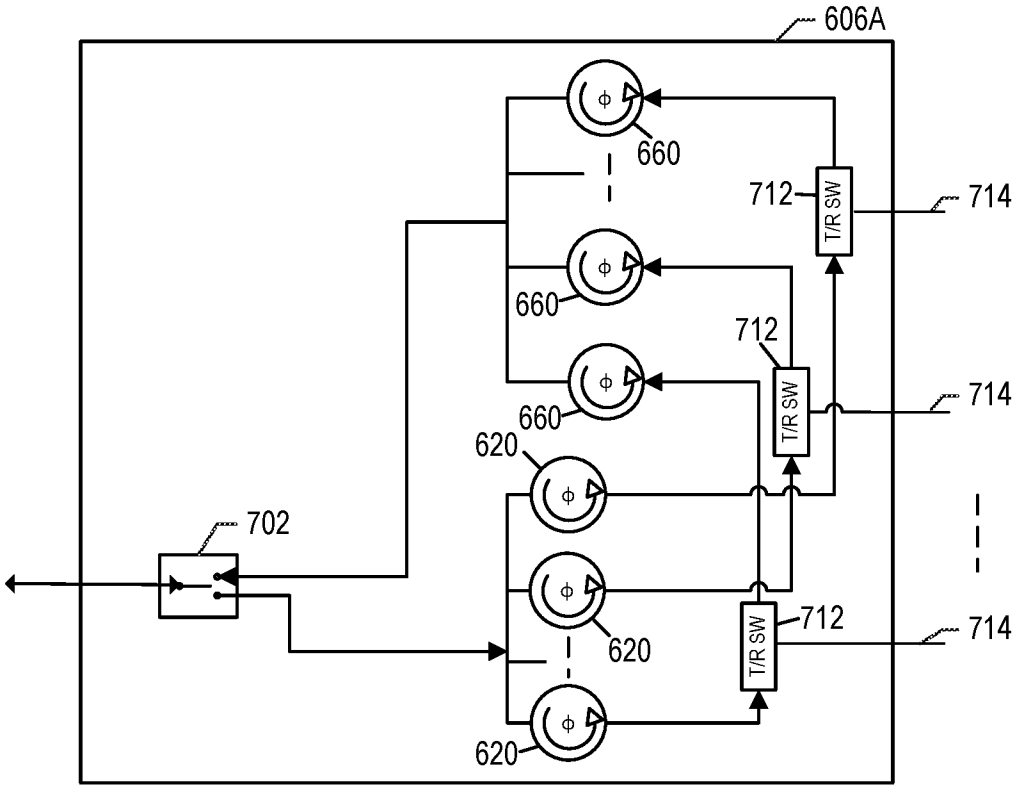
FIG. 7 illustrates an example analog steering circuit in accordance with one or more implementations.

FIG. 7 illustrates an example of the analog steering circuit 606A in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided. Similar components may be utilized in the analog steering circuit 606B and/or any analog steering circuit(s) of the analog beamforming circuit 210.

In the transmit path, a signal (e.g., an RF signal) is received from the tuner/converter circuit(s) 204, which is passed through a switch 702. The signal is split and passed to the gain/phase blocks 620 (e.g., transmit phase shifters). The gain/phase blocks 620 may apply phase shift and/or gain to the signal, as appropriate to implement directional beamforming, and transmits the processed signal through transmit/receive switches (T/R SWs) 712 and, e.g. external to the analog steering circuit 606A, via interconnections 714. The interconnections 714 may be coupled to the digital beamforming circuit 208 (e.g., the digital steering circuit 508).

Similarly, in the receive path, signals (e.g., RF signals) received via the interconnections 714 pass through the transmit/receive switches 712 and gain/phase blocks 660 (e.g., receive phase shifters), and are combined. The combined signal is transmitted through the switch 702, e.g. for processing of the received signal via a PHY receiver (e.g., of the PHY TX/RX 202). The gain/phase blocks 620 and 660 may receive control signals from a control interface circuit(s) (e.g., the control interface circuit 214).

In one or more implementations, one or more of the switch 702, the gain/phase blocks 620 and 660, the transmit/receive switches 712, and/or one or more portions thereof, may be implemented in software (e.g., subroutines and code), may be implemented in hardware (e.g., an Application Specific Integrated Circuit (ASIC), a Field Programmable Gate Array (FPGA), a Programmable Logic Device (PLD), a controller, a state machine, gated logic, discrete hardware components, or any other suitable devices) and/or a combination of both.

Figure 8:
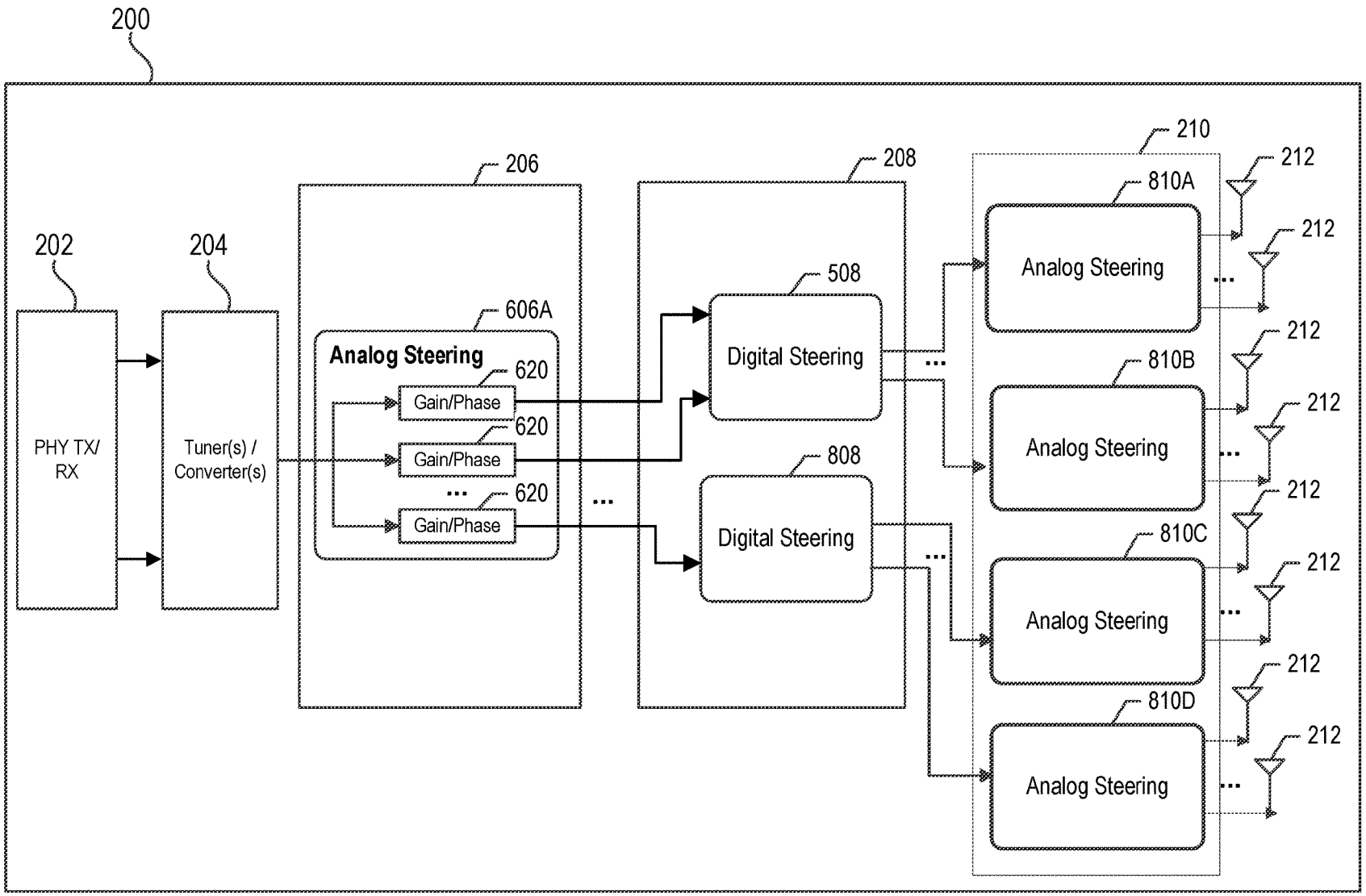
FIG. 8 illustrates an example transmit path of a hybrid beamforming circuit in accordance with one or more implementations.

FIG. 8 illustrates an example of a transmit path of the hybrid beamforming circuit 200 of FIG. 2 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The hybrid beamforming circuit 200 includes the PHY TX/RX 202, the tuner/converter circuit(s) 204, the analog beamforming circuit 206, the digital beamforming circuit 208, and the analog beamforming circuit 210. The analog beamforming circuit 206 includes the analog steering circuit 606A. The digital beamforming circuit 208 includes the digital steering circuit 508 and a digital steering circuit 808. In some cases, the digital steering circuit 808 may include components (e.g., FFT/IFFT circuits, gain/phase blocks) similar to those of the digital steering circuit 508 shown in FIG. 5A. The analog beamforming circuit 210 includes analog steering circuits 810A-D. In some cases, the analog steering circuits 810A-D may include components (e.g., gain/phase blocks) similar to those of the analog steering circuit 606A.

The analog steering circuit 606A receives an analog output signal of the tuner/converter circuit(s) 204. The analog output signal is split and passed to the gain/phase blocks 620 (e.g., transmit phase shifters) that apply phase shift and/or gain to the analog output signals, as appropriate to implement directional beamforming, and transmits the processed signals to the digital steering circuit 508 and the digital steering circuit 808. The digital steering circuits 508 and 808 each have a respective matrix combining. The digital steering circuit 508 generates and transmits analog signals to analog steering circuits 810A-B, and the digital steering circuit 808 generates and transmits analog signals to analog steering circuits 810C-D. The analog steering circuits 810A-D are each associated with a respective stream. The analog steering circuits 810A-D may be coupled to respective antenna elements of the antenna element(s) 212 via respective power amplifiers (not shown). In some cases, the beams transmitted and/or received by the analog steering circuits 810A-D may be associated with different beam powers and/or beam directions. Although FIG. 8 illustrates a transmit path of the hybrid beamforming circuit 200, the hybrid beamforming circuit 200 may also include a receive path.

In one or more implementations, the hybrid beamforming circuit 200 may include more, fewer, and/or different steering circuits in the analog beamforming circuit 206, digital beamforming circuit 208, and/or analog beamforming circuit 210 than those illustrated in the figures. Furthermore, the hybrid beamforming circuit 200 may include one or more additional layers of analog beamforming and/or digital beamforming. For each of the analog beamforming circuit 206, digital beamforming circuit 208, and/or analog beamforming circuit 210, the number of steering circuits utilized in the transmit path may be the same, or may be different, from the number of steering circuits utilized in the receive path.

In one or more implementations, a base station (e.g., the base station 102A) implementing the subject system may include antenna elements (e.g., the antenna element(s) 212) that are utilized for communication between the base station and another base station and/or one or more user devices. For example, the base station may transmit signals to and/or receive signals from a user device. In some cases, a first subset of antenna elements may be utilized for communication between the base station and a first user device, and a second subset of antenna elements may be utilized for communication between the base station and a second user device. The first subset of antenna elements may be exclusive of the second subset of antenna elements. In some cases, the first subset may include a number of antenna elements and the second subset may include a different number of antenna elements. For example, the base station may include 1024 antenna elements, of which a portion of the antenna elements (e.g., 333 antenna elements) are utilized for communication between the base station and the first user device and another portion of the antenna elements (e.g., 476 antenna elements) are utilized for communication between the base station and the second user device.

In one or more implementations, the first subset and the second subset of antenna elements are selected based on one or more criteria, such as link requirements between the base station and the first and second user devices, distance between the base station and the first and second user devices, required signal strength, etc. For example, the first user device may be closer to the base station than the second user device. In such a case, the base station may allocate more antenna elements (e.g., to allow higher gain) for communicating with the second user device and fewer antenna elements for communicating with the first user device.

In one or more implementations, the antenna elements may be divided into a plurality of groups of antenna elements, with each group including at least one antenna element. Analog beamforming and/or digital beamforming may be applied separately to the signals in each group of antenna elements. Each group may further be divided into subgroups, with each subgroup being associated with respective analog beamforming and/or digital beamforming. For example, the base station device may include 100 antenna elements. A first group of antenna elements may include 50 of the antenna elements and a second group of antenna elements may include the remaining 50 of the antenna elements. A first analog beamforming and/or a first digital beamforming may be applied to the first group of antenna elements. A second analog beamforming and/or a second digital beamforming may be applied to the second group of antenna elements. For example, the first group of antenna elements and the second group of antenna elements may be utilized to effectuate a first beam setting and a second beam setting, respectively.

In some cases, the base station's antenna elements may be arranged (e.g., in a row) and dithering may be applied. For example, every third antenna element in the row may be switched on for communication between the base station and the first user device. In some cases, some or all of the antenna elements interspersed between the antenna elements that are utilized for communication with the first user device may be utilized for communication with the second user device. In some cases, the dithering may utilize a non-integer factor. For example, to have every 3.5 antenna elements switched on for a user device, a first antenna element in the row may be switched on, a fourth antenna element in the row may be switched on, and an eighth antenna element may be switched on, and so forth, such that the average distance between antenna antennas that are switched on is around 3.5 antenna elements over the entire row of antenna elements. Dithering is discussed further below with respect to FIG. 9.

Figure 9:
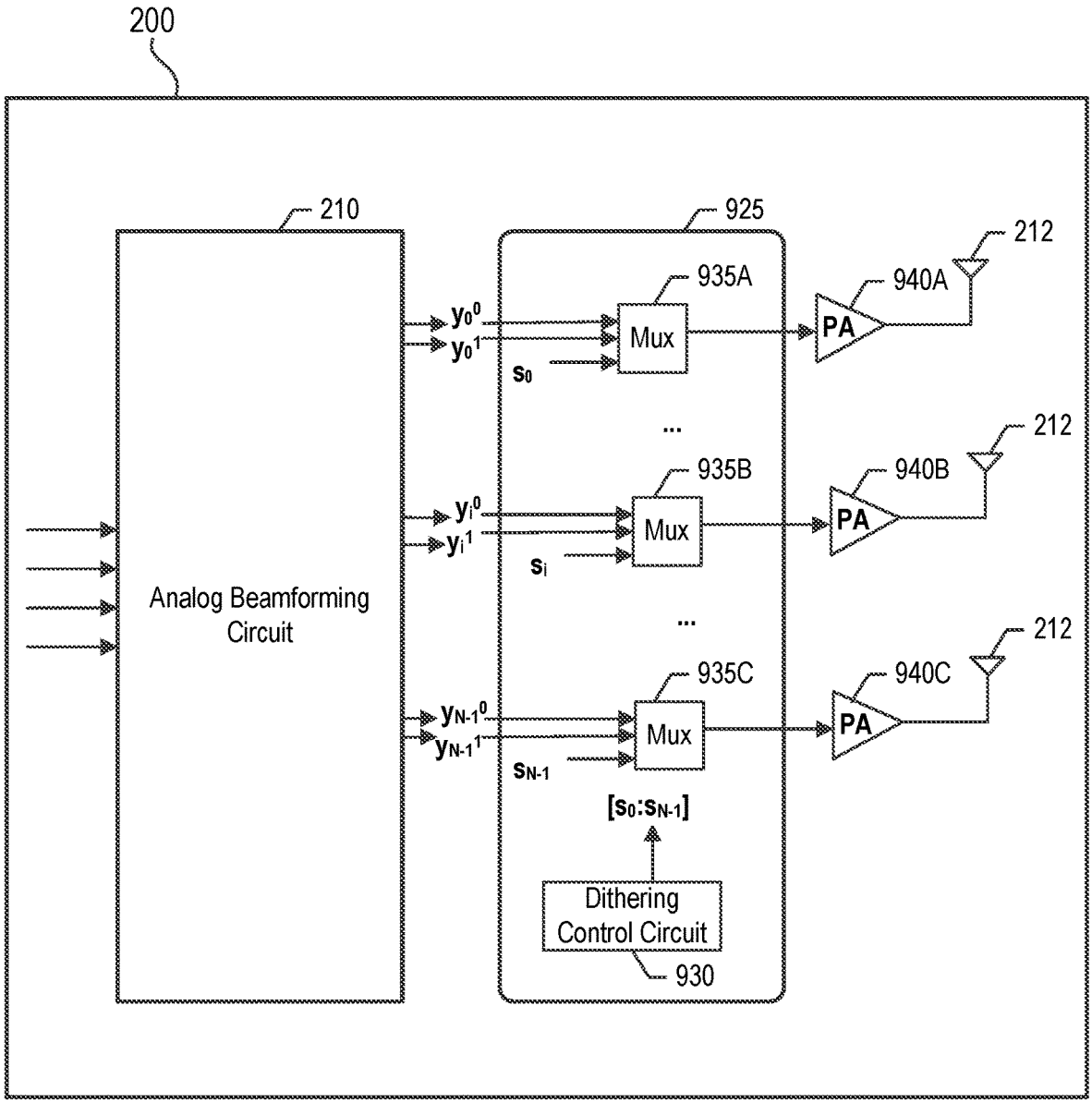
FIG. 9 illustrates an example of dithering circuit of a hybrid beamforming circuit in accordance with one or more implementations.

FIG. 9 illustrates an example dithering circuit 925 of a hybrid beamforming circuit 200 in accordance with one or more implementations. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

The dithering may be applied by a dithering circuit 925 prior to signals being transmitted to the antenna element(s) 212 via power amplifiers 940A-C. The analog beamforming circuit 210 may be coupled to the antenna element(s) 212 via the dithering circuit 925 and the power amplifiers 940A-C. The dithering circuit 925 includes a dithering control circuit 930 that generates selection signals $[s_0:s_{N-1}]$, where N is the number of antennas. The dithering circuit 925 includes multiplexers 935A-C. Each of the multiplexers 935A-C receives a signal $y_i^0$ and $y_i^1$, where i may be considered an index of an antenna. In some cases, the multiplexers 935A-C may allow the $y_i^0$ signal to pass through and block the $y_i^1$ signal when $s_i=1$ and may block the $y_i^0$ signal and allow the $y_i^1$ signal to pass through when $s_i=0$. In some cases, the $y_i^0$ or $y_i^1$ signal may be a null signal (zero signal). In such cases, the multiplexers 935A-C and the selection signals may be considered a switch and switch signals, respectively.

The dithering circuit 925 may be utilized to allow a non-integer-based desired antenna selection for a signal. For instance, a desired antenna selection to allow desired beamforming for communication with a user device may be $y^0$=[0 2.75 5.5 8.25]. In other words, signals should be transmitted from a $0^{th}$ antenna element, $2.75^{th}$ antenna element, $5.5^{th}$ antenna element, and an $8.25^{th}$ antenna element should be turned on. For instance, to achieve the fractional $2.75^{th}$ antenna to be on, the dithering circuit 925 may cause the second antenna element to be on 25% of the time and the third antenna element to be on 75% of the time. An example manner to switch on the antenna elements for time t=0, 1, 2, and 3 may be given by s(t(0))=[0 2 5 8], s(t(1))=[0 3 6 8], s(t(2))=[0 3 5 9], and s(t(3))=[0 3 6 8], such that the expected antenna selection is E(s)=[0 2.75 5.5 8.25]. Other manners by which to switch on the various antenna elements may be utilized. In some cases, simultaneous with the transmission associated with $y^0$, the antenna element(s) 212 not utilized for $y^0$ may be utilized for transmission to one or more other user devices.

In some cases, the dithering may be utilized in a large fixed antenna array. The dithering circuit 925 may allow achievement of an average response. The dithering circuit 925 may utilize noise shaping on selection mapping to achieve average response and/or suppress noise in certain bands.

In one or more implementations, the dithering circuit 925, and/or one or more portions thereof, may be implemented in software (e.g., subroutines and code), may be implemented in hardware (e.g., an Application Specific Integrated Circuit (ASIC), a Field Programmable Gate Array (FPGA), a Programmable Logic Device (PLD), a controller, a state machine, gated logic, discrete hardware components, or any other suitable devices) and/or a combination of both.

In one or more implementations, an overall spectral efficiency associated with a beamformed millimeter wave packet may be improved by progressively decreasing the quadrature amplitude modulation (QAM) constellation at frequencies away from the center frequency. In some cases, the packet structure may be matched to the rolloff on the RF beamforming phase accuracy. For example, the packet structure may use quadrature phase-shift keying (QPSK) on roll-off and 1024 QAM in the middle. The packet structure may be made as a function of angle of arrival or angle of departure.

Figure 10:
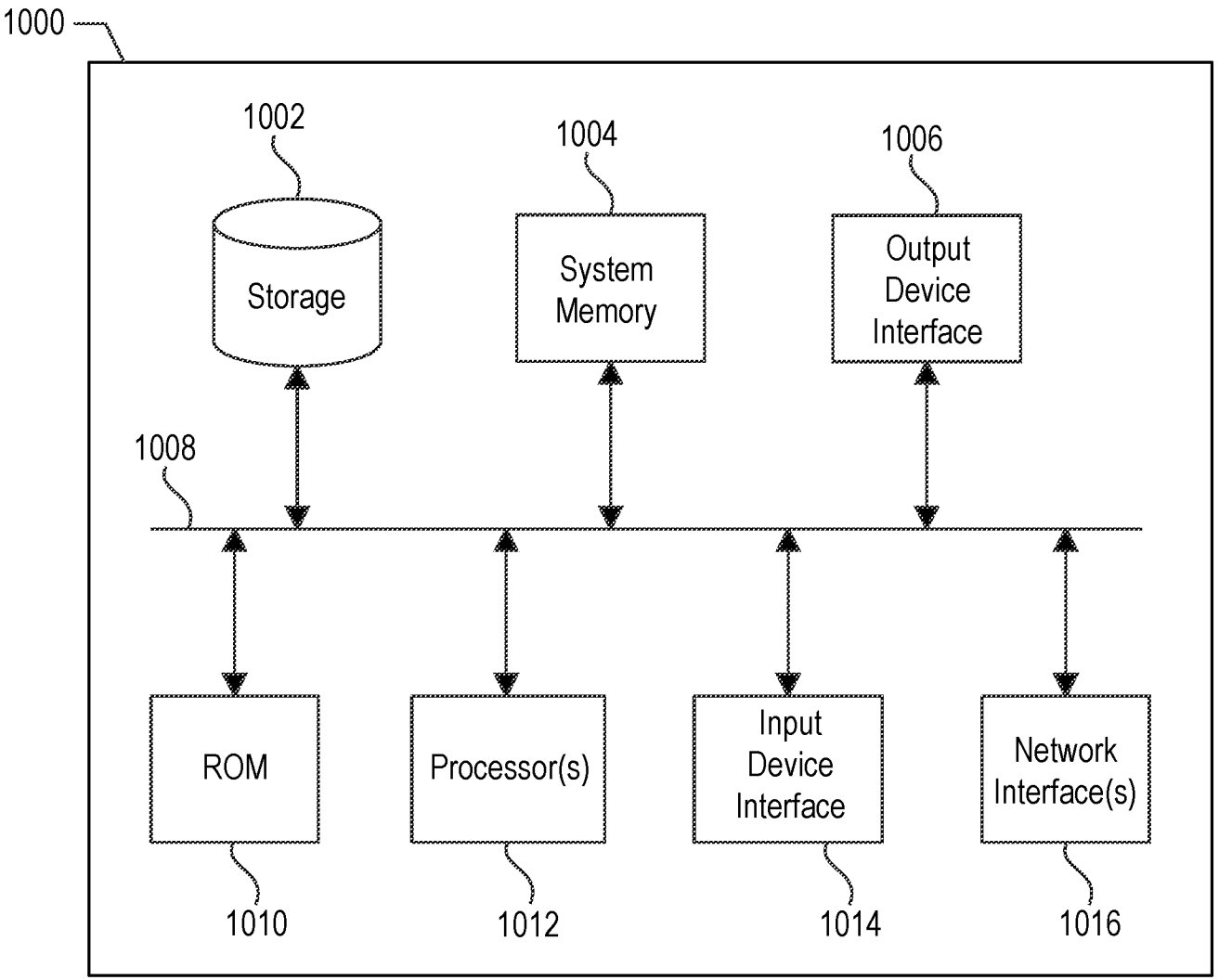
FIG. 10 conceptually illustrates an electronic system with which one or more implementations of the subject technology may be implemented.

FIG. 10 conceptually illustrates an electronic system 1000 with which one or more implementations of the subject technology may be implemented. The electronic system 1000, for example, can be a wireless backhaul device, a user equipment, a computer, a server, a switch, a router, a base station (e.g., the base stations 102A-E), a user device (e.g., the user devices 104A-C), a phone, a femtocell, a macrocell, a picocell, a small cell, or generally any electronic device that transmits wireless signals. Such an electronic system includes various types of computer readable media and interfaces for various other types of computer readable media. The electronic system 1000 includes a bus 1008, one or more processing unit(s) 1012, a system memory 1004 (and/or buffer), a read-only memory (ROM) 1010, a permanent storage device 1002, an input device interface 1014, an output device interface 1006, and one or more network interfaces 1016, or subsets and variations thereof.

The bus 1008 collectively represents all system, peripheral, and chipset buses that communicatively connect the numerous internal devices of the electronic system 1000. In one or more implementations, the bus 1008 communicatively connects the one or more processing unit(s) 1012 with the ROM 1010, the system memory 1004, and the permanent storage device 1002. From these various memory units, the one or more processing unit(s) 1012 retrieves instructions to execute and data to process in order to execute the processes of the subject disclosure. The one or more processing unit(s) 1012 can be a single processor or a multi-core processor in different implementations.

The ROM 1010 stores static data and instructions that are needed by the one or more processing unit(s) 1012 and other modules of the electronic system 1000. The permanent storage device 1002, on the other hand, may be a read-and-write memory device. The permanent storage device 1002 may be a non-volatile memory unit that stores instructions and data even when the electronic system 1000 is off. In one or more implementations, a mass-storage device (such as a magnetic or optical disk and its corresponding disk drive) may be used as the permanent storage device 1002.

In one or more implementations, a removable storage device (such as a floppy disk, flash drive, and its corresponding disk drive) may be used as the permanent storage device 1002. Like the permanent storage device 1002, the system memory 1004 may be a read-and-write memory device. However, unlike the permanent storage device 1002, the system memory 1004 may be a volatile read-and-write memory, such as random access memory. The system memory 1004 may store any of the instructions and data that one or more processing unit(s) 1012 may need at runtime. In one or more implementations, the processes of the subject disclosure are stored in the system memory 1004, the permanent storage device 1002, and/or the ROM 1010. From these various memory units, the one or more processing unit(s) 1012 retrieves instructions to execute and data to process in order to execute the processes of one or more implementations.

The bus 1008 also connects to the input and output device interfaces 1014 and 1006. The input device interface 1014 enables a user to communicate information and select commands to the electronic system 1000. Input devices that may be used with the input device interface 1014 may include, for example, alphanumeric keyboards and pointing devices (also called "cursor control devices"). The output device interface 1006 may enable, for example, the display of images generated by electronic system 1000. Output devices that may be used with the output device interface 1006 may include, for example, printers and display devices, such as a liquid crystal display (LCD), a light emitting diode (LED) display, an organic light emitting diode (OLED) display, a flexible display, a flat panel display, a solid state display, a projector, or any other device for outputting information. One or more implementations may include devices that function as both input and output devices, such as a touchscreen. In these implementations, feedback provided to the user can be any form of sensory feedback, such as visual feedback, auditory feedback, or tactile feedback; and input from the user can be received in any form, including acoustic, speech, or tactile input.

Finally, as shown in FIG. 10, the bus 1008 also couples the electronic system 1000 to a network (not shown) and/or to one or more devices through the one or more network interface(s) 1016, such as one or more wireless network interfaces (e.g. mmWave). In this manner, the electronic system 1000 can be a part of a network of computers (such as a local area network ("LAN"), a wide area network ("WAN"), or an Intranet, or a network of networks, such as the Internet. Any or all components of the electronic system 1000 can be used in conjunction with the subject disclosure.

Implementations within the scope of the present disclosure can be partially or entirely realized using a tangible computer-readable storage medium (or multiple tangible computer-readable storage media of one or more types) encoding one or more instructions. The tangible computer-readable storage medium also can be non-transitory in nature.

The computer-readable storage medium can be any storage medium that can be read, written, or otherwise accessed by a general purpose or special purpose computing device, including any processing electronics and/or processing circuitry capable of executing instructions. For example, without limitation, the computer-readable medium can include any volatile semiconductor memory, such as RAM, DRAM, SRAM, T-RAM, Z-RAM, and TTRAM. The computer-readable medium also can include any non-volatile semiconductor memory, such as ROM, PROM, EPROM, EEPROM, NVRAM, flash, nvSRAM, FeRAM, FeTRAM, MRAM, PRAM, CBRAM, SONOS, RRAM, NRAM, racetrack memory, FJG, and Millipede memory.

Further, the computer-readable storage medium can include any non-semiconductor memory, such as optical disk storage, magnetic disk storage, magnetic tape, other magnetic storage devices, or any other medium capable of storing one or more instructions. In some implementations, the tangible computer-readable storage medium can be directly coupled to a computing device, while in other implementations, the tangible computer-readable storage medium can be indirectly coupled to a computing device, e.g., via one or more wired connections, one or more wireless connections, or any combination thereof.

Instructions can be directly executable or can be used to develop executable instructions. For example, instructions can be realized as executable or non-executable machine code or as instructions in a high-level language that can be compiled to produce executable or non-executable machine code. Further, instructions also can be realized as or can include data. Computer-executable instructions also can be organized in any format, including routines, subroutines, programs, data structures, objects, modules, applications, applets, functions, etc. As recognized by those of skill in the art, details including, but not limited to, the number, structure, sequence, and organization of instructions can vary significantly without varying the underlying logic, function, processing, and output.

While the above discussion primarily refers to microprocessor or multi-core processors that execute software, one or more implementations are performed by one or more integrated circuits, such as application specific integrated circuits (ASICs) or field programmable gate arrays (FPGAs). In one or more implementations, such integrated circuits execute instructions that are stored on the circuit itself.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order, or partitioned in a different way) all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As used in this specification and any claims of this application, the terms "base station", "receiver", "computer", "server", "processor", and "memory" all refer to electronic or other technological devices. These terms exclude people or groups of people. For the purposes of the specification, the terms "display" or "displaying" means displaying on an electronic device.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The predicate words "configured to", "operable to", and "programmed to" do not imply any particular tangible or intangible modification of a subject, but, rather, are intended to be used interchangeably. In one or more implementations, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as an "aspect" may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such an "embodiment" may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as a "configuration" may refer to one or more configurations and vice versa.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. A device comprising:

at least one processor configured to:

determine a first beam setting based on a first set of criteria associated with a first user device;

form a first beam based on the first beam setting using two radio frequency (RF) beamforming circuits and at least one digital beamforming circuit, the at least one digital beamforming circuit being interspersed between the two radio frequency beamforming circuits; and transmit, via first antenna elements, the first beam to the first user device.

2. The device of claim 1, wherein the at least one processor is further configured to:

select the first antenna elements from a plurality of antenna elements based on the first beam setting.

3. The device of claim 2, wherein the at least one processor is further configured to:

determine a second beam setting based on a second set of criteria associated with a second user device; and transmit, via second antenna elements of the plurality of antenna elements, a second beam to the second user device, wherein the second beam is associated with the second beam setting.

4. The device of claim 3, wherein the at least one processor is further configured to:

modify the first beam setting based on the second beam, wherein the modified first beam setting is associated with at least one null position;

transmit, via the first antenna elements, a third beam to the first user device, wherein the third beam is associated with the modified first beam setting; and transmit, via the second antenna elements, a fourth beam to the second user device, wherein the fourth beam is associated with the second beam setting.

5. The device of claim 4, wherein the at least one processor is further configured to concurrently transmit the third and fourth beams.

6. The device of claim 1, wherein the at least one processor is further configured to form the first beam by:

applying a first plurality of phase shifts to a first plurality of RF signals via a first RF beamforming circuit of the two RF beamforming circuits;

applying a second plurality of phase shifts to a first plurality of digital signals via the at least one digital beamforming circuit, wherein the first plurality of digital signals is based on the first plurality of RF signals; and applying a third plurality of phase shifts to a second plurality of RF signals via a second RF beamforming circuit of the two RF beamforming circuits, wherein the second plurality of RF signals is based on the first plurality of digital signals, the first beam is based on the second plurality of RF signals and the at least one digital beamforming circuit is interspersed between the at least two RF beamforming circuits.

7. The device of claim 6, wherein the at least one processor is further configured to:

determine the second plurality of phase shifts, wherein the second plurality of phase shifts compensates for phase distortion associated with at least one of applying the first plurality of phase shifts or applying the third plurality of phase shifts.

8. The device of claim 1, wherein the at least one processor is further configured to:

apply a first plurality of phase shifts to at least one RF signal to obtain a first plurality of RF signals;

convert the first plurality of RF signals to a first plurality of digital signals;

apply a second plurality of phase shifts to the first plurality of digital signals to obtain a second plurality of digital signals;

convert the second plurality of digital signals to a second plurality of RF signals;

apply a third plurality of phase shifts to the second plurality of RF signals to obtain a third plurality of RF signals; and apply each of the third plurality of RF signals to a respective one of the first antenna elements, wherein the at least one processor is configured to transmit the first beam responsive to applying each of the third plurality of RF signals to a respective one of the first antenna elements.

9. The device of claim 1, wherein the at least one digital beamforming circuit is configured to compensate for a frequency offset associated with at least one of the at least two RF beamforming circuits.

10. A method comprising:

determining a first beam setting based on a first set of criteria associated with a first user device;

forming a first beam based on the first beam setting using at least one digital beamforming circuit and at least one radio frequency (RF) beamforming circuit, wherein phase shifts applied by the at least one digital beamforming circuit are based at least on phase shifts applied by the at least one RF beamforming circuit; and transmitting, via first antenna elements, the first beam to the first user device.

11. The method of claim 10, further comprising selecting the first antenna elements from a plurality of antenna elements based on the first beam setting.

12. The method of claim 11, further comprising:

determining a second beam setting based on a second set of criteria associated with a second user device;

selecting second antenna elements from the plurality of antenna elements based at least on the second beam setting; and transmitting, via the second antenna elements, a second beam to the second user device, wherein the second beam is associated with the second beam setting.

13. The method of claim 12, wherein the first and second beams are concurrently transmitted.

14. The method of claim 13, wherein the first and second beams are at a same frequency.

15. The method of claim 12, further comprising:

determining a third beam setting based on the second beam, wherein a null position associated with the third beam setting is based at least on the second beam;

selecting third antenna elements of the plurality of antenna elements based at least on the third beam setting; and transmitting, via the third antenna elements, a third beam to the first user device, wherein the third beam is associated with the third beam setting.

16. The method of claim 15, further comprising:

determining a fourth beam setting based on the third beam, wherein a null position associated with the fourth beam setting is based at least on the third beam;

selecting fourth antenna elements of the plurality of antenna elements based at least on the fourth beam setting; and transmitting, via the fourth antenna elements, a fourth beam to the second user device, wherein the fourth beam is associated with the fourth beam setting.

17. The method of claim 10, wherein the at least one digital beamforming circuit is interspersed between the at least one RF beamforming circuit and another RF beamforming circuit.

18. The method of claim 17, wherein forming the first beam comprises:

applying a first plurality of phase shifts to a first plurality of RF signals via the at least one RF beamforming circuit;

applying a second plurality of phase shifts to a first plurality of digital signals via the at least one digital beamforming circuit, wherein the first plurality of digital signals is based on the first plurality of RF signals; and applying a third plurality of phase shifts to a second plurality of RF signals via the another RF beamforming circuit, wherein the second plurality of RF signals is based on the first plurality of digital signals, and wherein the first beam is based on the second plurality of RF signals, wherein the second plurality of phase shifts compensates for phase distortion associated with at least one of applying the first plurality of phase shifts or applying the third plurality of phase shifts.

19. A computer program product comprising instructions stored in a tangible computer-readable storage medium, the instructions comprising:

instructions to determine a first beam setting based at least on a first set of criteria associated with a first user device and a second set of criteria associated with a second user device;

instructions to form a first beam based on the first beam setting using at least one digital beamforming circuit and at least one radio frequency (RF) beamforming circuit; and instructions to transmit the first beam to the first user device.

20. The computer program product of claim 19, wherein the at least one digital beamforming circuit is interspersed between the at least one RF beamforming circuit and another RF beamforming circuit.

* * * * *